US009102497B2

(12) United States Patent
Tokuma

(10) Patent No.: US 9,102,497 B2
(45) Date of Patent: Aug. 11, 2015

(54) SHEET STACKING APPARATUS, SHEET PROCESSING APPARATUS AND IMAGE FORMING APPARATUS

(71) Applicant: CANON KABUSHIKI KAISHA, Tokyo (JP)

(72) Inventor: Naoto Tokuma, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/863,642

(22) Filed: Apr. 16, 2013

(65) Prior Publication Data

US 2013/0285314 A1 Oct. 31, 2013

(30) Foreign Application Priority Data

Apr. 27, 2012 (JP) ..... 2012-103010
Apr. 5, 2013 (JP) ..... 2013-079260

(51) Int. Cl.
*B65H 31/34* (2006.01)
*B65H 31/36* (2006.01)
*B65H 31/38* (2006.01)

(52) U.S. Cl.
CPC ..... *B65H 31/34* (2013.01); *B65H 31/36* (2013.01); *B65H 31/38* (2013.01); *B65H 2405/11151* (2013.01); *B65H 2511/22* (2013.01); *B65H 2511/51* (2013.01); *B65H 2513/50* (2013.01); *B65H 2701/1315* (2013.01); *B65H 2801/06* (2013.01)

(58) Field of Classification Search
CPC ..... B65H 31/34; B65H 31/36; B65H 31/38; B65H 31/20; B65H 2511/12; B65H 2511/22
USPC ..... 271/220, 221, 223, 207; 399/405, 407; 270/58, 58.11, 58.12, 58.13, 58.14, 270/58.17
See application file for complete search history.

(56) References Cited

U.S. PATENT DOCUMENTS 5,092,509 A * 3/1992 Naito et al. ..... 227/99
5,622,359 A * 4/1997 Kawano et al. ..... 270/58.12
2003/0062669 A1* 4/2003 Yamakawa et al. ..... 271/176
2007/0057441 A1* 3/2007 Tsutsui et al. ..... 271/207

(Continued)

FOREIGN PATENT DOCUMENTS

JP H08-169623 A 7/1996
JP 2002-211829 A 7/2002

(Continued)

*Primary Examiner* — Luis A Gonzalez
(74) *Attorney, Agent, or Firm* — Fitzpatrick, Cella, Harper & Scinto

(57) ABSTRACT

The invention provides a sheet stacking apparatus including a stacking tray whose stacking surface is inclined, a sheet presence/absence detecting sensor that detects presence and absence of a sheet on the stacking surface, an abutting member to which an end of the sheet on the stacking surface abuts, an alignment mechanism that aligns the sheet on the stacking surface widthwise by a pair of aligning members, and a control portion that controls the aligning mechanism. Determining presence of the sheet on the stacking tray from a detected result of the sheet presence/absence detecting sensor, the control portion aligns the sheet by setting a distance between aligning faces of the pair of aligning members as a first distance, and determining absence of the sheet, the control portion sets the distance between the aligning faces of the pair of aligning members as a second distance which is wider than the first distance.

24 Claims, 13 Drawing Sheets

(56) References Cited

U.S. PATENT DOCUMENTS

| | | | | |
|---|---|---|---|---|
| 2009/0066003 | A1* | 3/2009 | Kunieda et al. | 271/3.02 |
| 2010/0019435 | A1* | 1/2010 | Fukami | 270/58.11 |
| 2012/0313317 | A1 | 12/2012 | Gamo et al. | |
| 2012/0319346 | A1 | 12/2012 | Iwata et al. | |
| 2013/0026695 | A1 | 1/2013 | Tokuma | |
| 2013/0049278 | A1* | 2/2013 | Tsuchiya et al. | 270/45 |
| 2013/0093134 | A1* | 4/2013 | Mizubata et al. | 270/58.01 |

FOREIGN PATENT DOCUMENTS

| | | | |
|---|---|---|---|
| JP | 2003-002524 | A | 1/2003 |
| JP | 2006-273543 | A | 10/2006 |

* cited by examiner

SHEET STACKING APPARATUS, SHEET PROCESSING APPARATUS AND IMAGE FORMING APPARATUS

BACKGROUND OF THE INVENTION

1. Field of the Invention

The present invention relates to a sheet stacking apparatus configured to be able to align a sheet stacked on a stacking tray, an image forming apparatus, and a sheet processing apparatus.

2. Description of the Related Art

Hitherto, there is known a sheet stacking apparatus adapted to be able to align sheets discharged out to a stacking tray for stacking sheets in a sheet widthwise direction (referred to simply as a "width direction" or "widthwise" hereinafter) orthogonal to a direction in which the sheet is discharged (referred to simply as a "discharge direction" hereinafter) as disclosed in Japanese Patent Application Laid-open No. 2002-211829 for example.

The sheet stacking apparatus described in Japanese Patent Application Laid-open No. 2002-211829 includes a pair of aligning members capable of moving in the width direction above a stacking tray. When a sheet is discharged out to the stacking tray, the sheet stacking apparatus aligns the sheet widthwise by moving the pair of aligning members in the width direction so that the aligning members come in contact with both widthwise ends of the sheet.

By the way, the sheet stacking apparatus described in Japanese Patent Application Laid-open No. 2002-211829 aligns a sheet by sandwiching the sheet widthwise between the pair of aligning members, i.e., by making the pair of aligning members come into contact with the both widthwise ends of the sheet, by moving the aligning members widthwise after the elapse of a predetermined time since when the sheet has been discharged out of a sheet discharging portion. The predetermined time until when the pair of aligning members starts to move is set based on a time until when the sheet discharged on an inclined stacking surface of the stacking tray abuts an abutting member against which an end in the discharge direction of the sheet is to be abutted by its own weight or the like. That is, the sheet stacking apparatus is configured so that normally the sheet stacking apparatus aligns the sheet in the width direction by the pair of aligning members after the elapse of the predetermined time since when the sheet has been aligned in the discharge direction by abutting against the abutting member.

However, if such move of the sheet is delayed by some reason, there is a possibility that the predetermined time elapses before the sheet reaches the abutting member and the sheet moving on the inclined stacking tray is held by the pair of aligning members before reaching the abutting member. If the sheet is held and aligned by the pair of aligning members here, there is also a possibility that the sheet in the move is stopped. When there is no sheet on the stacking tray in particular, the sheet is less movable on the stacking surface than a case in which another sheet is already stacked on the stacking tray, because level of kinetic friction force between the stacking surface and the sheet is higher than that between sheets. Due to that, if the sheet is held in this condition from the both ends in the width direction by the pair of aligning members, there is such a possibility that the sheet is stopped before abutting the abutting member. If the sheet is stopped during its move, it becomes even more difficult to move the sheet again because of a static friction force which is caused between a halted sheet and the stacking surface of the stacking tray and which is greater than the kinetic friction force between the stacking surface and a sheet. Due to that, it is unable to align the sheet in the discharge direction by the abutting member, possibly causing stacking misalignment in the discharge direction among the sheets discharged first and discharged afterward. In short, the sheet stacking apparatus has the possibility of causing the stacking misalignment in the discharge direction among sheets discharged first and thereafter if the sheet moving on the inclined stacking surface is stopped on its way by being held by the pair of aligning members.

SUMMARY OF THE INVENTION

The invention provides a sheet stacking apparatus including a sheet discharging portion configured to discharge a sheet, a stacking tray having an inclined stacking surface on which the sheet discharged from the sheet discharging portion is stacked, a sheet presence/absence detecting sensor that detects whether the sheet is present or absent on the stacking surface of the stacking tray, an abutting member against which an end in a sheet discharge direction of the discharged sheet that moves along an inclination of the stacking surface abuts, an alignment mechanism including a pair of aligning members respectively having aligning faces that align the sheet discharged onto the stacking surface in the sheet width direction, and a control portion that controls the aligning mechanism such that a distance between the aligning faces of the pair of aligning members is set as a first distance to sandwich the sheet discharged onto the stacking surface by the aligning faces of the pair of aligning members to align the sheet in the sheet width direction in a case when the control portion determines presence of the sheet on the stacking surface of the stacking tray based on a detected result of the sheet presence absence detecting sensor, and controls the aligning mechanism such that the distance between the aligning faces of the pair of aligning members is set as a second distance which is wider than a widthwise length of the sheet discharged onto the stacking surface by a predetermined amount in a case when the control portion determines absence of the sheet on the stacking surface of the stacking tray based on the detected result of the sheet presence/absence detecting sensor.

Further features of the present invention will become apparent from the following description of exemplary embodiments with reference to the attached drawings.

DESCRIPTION OF THE EMBODIMENT

An image forming apparatus including a sheet stacking apparatus of an embodiment of the invention will now be described with reference to the drawings.

Figure 1:
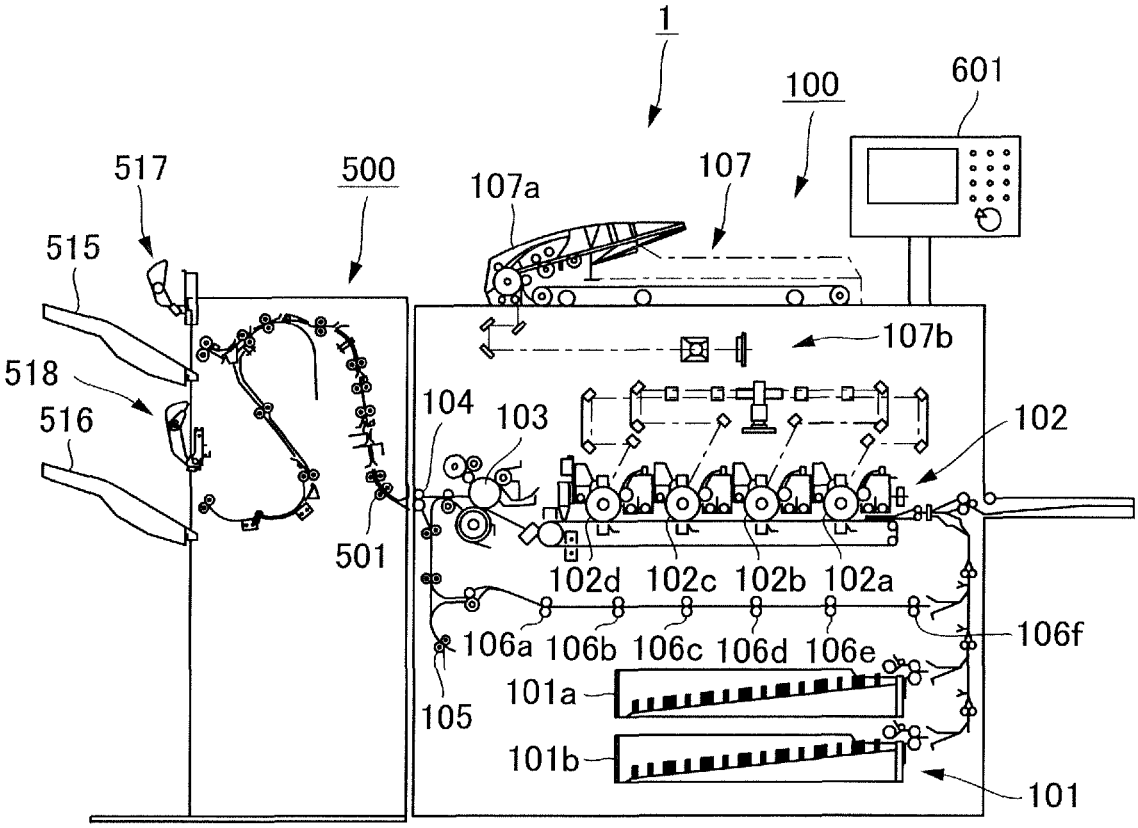
FIG. 1 is a schematic section view illustrating an entire structure of a multifunction printer according an embodiment of the invention.
Figure 2:
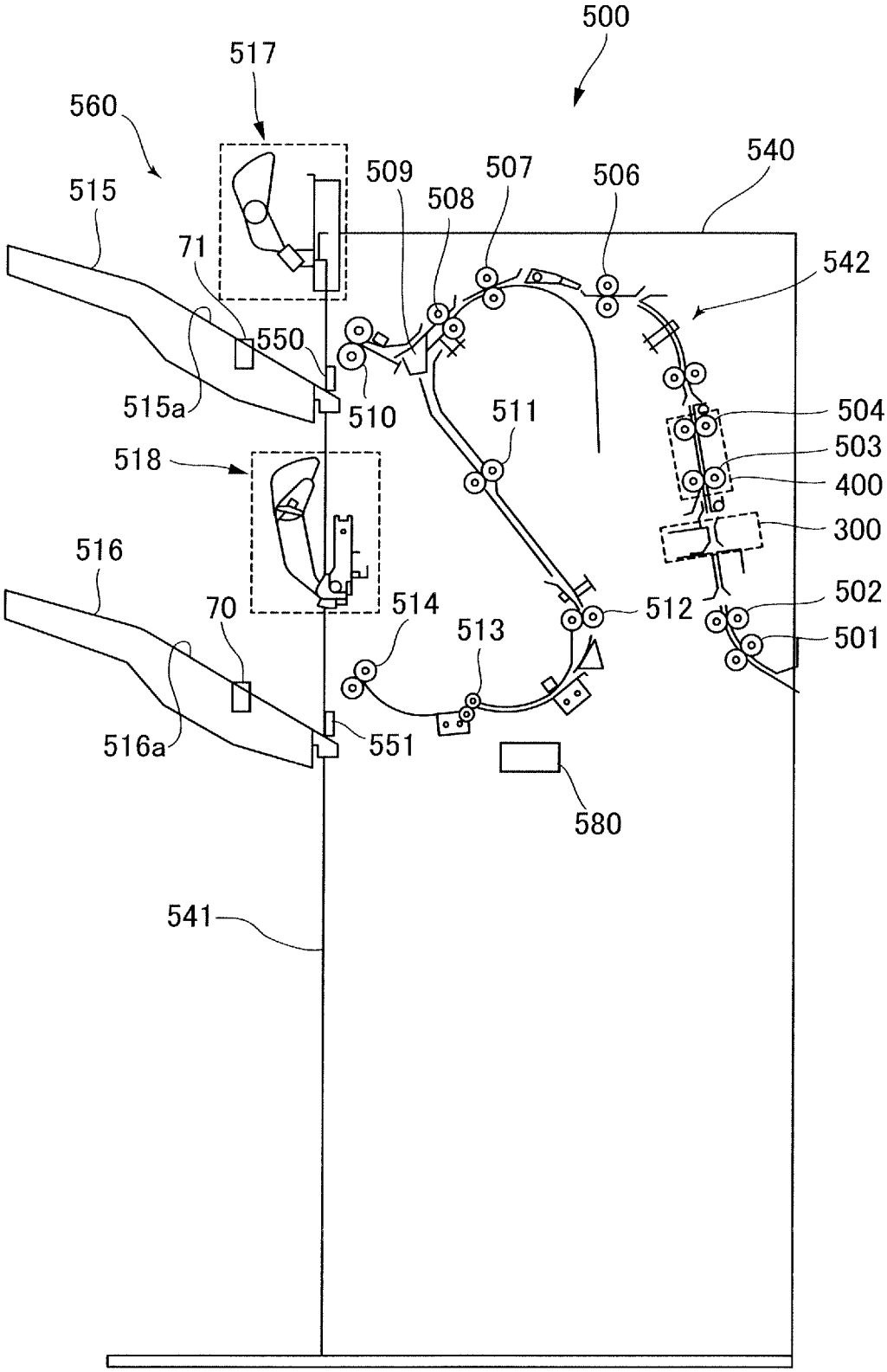
FIG. 2 is a schematic section view illustrating an entire structure of a finisher of the embodiment.

A color multifunction printer 1 (referred to simply as a "multifunction printer" hereinafter) as the image forming apparatus of the present embodiment of the invention will be described with reference to FIGS. 1 through 13. An entire structure of the multifunction printer 1 of the embodiment will be described first along moves of a sheet S with reference to FIGS. 1 and 2. FIG. 1 is a section view schematically illustrating the entire structure of the multifunction printer 1 of the embodiment, and FIG. 2 is a section view schematically illustrating an entire structure of a finisher 500 of the embodiment.

As shown in FIG. 1, the multifunction printer 1 of the present embodiment includes a copier 100 configured to form an image on a sheet, and a finisher 500 as a sheet processing apparatus connected to the copier 100. The finisher 500 of the present embodiment is configured to be optionally attachable to the copier 100, while the copier 100 is solely usable. The finisher 500 of the present embodiment is configured to perform, as a predetermined sheet processing operation, a process for aligning a plurality of sheets on which images have been formed. The sheet processing operation is carried out in accordance to setting input by a user through an operating portion 601 provided in the copier 100.

It is noted that although the invention will be described by using the abovementioned attachable finisher 500 in the present embodiment, the copier 100 and the finisher 500 may be integrated as an integrated multifunction printer. Still further, the positions where the user faces to the operating portion 601 through which the user inputs/sets variously to the multifunction printer 1 will be referred to as "front" or "a front side" of the multifunction printer 1 and behind the multifunction printer 1 as "back" or "a back side" hereinafter. That is, FIG. 1 shows an inner structure of the multifunction printer 1 viewed from the front side, in which the finisher 500 is connected to a side of the copier 100.

The copier 100 includes a sheet storage portion 101 configured to store sheets, an image forming portion 102 configured to form images on the sheets fed from the sheet storage portion 101, a fixing portion 103 configured to fix the images formed in the image forming portion 102 on the sheet, and an image reading portion 107 configured to read document images.

The image reading portion 107 has a document feed portion 107*a* that automatically feeds a document, and an document reading portion 107*b* that reads the document. Image data of the document read by the document reading portion 107*b* is sent to the image forming portion 102. The image forming portion 102 includes photosensitive drums 102*a* through 102*d* around which toner images of respective colors of yellow, magenta, cyan, and black are formed based on the image data read by the document reading portion 107*b*.

The sheet storage portion 101 has cassettes 101*a* and 101*b* configured to store sheets and feeds the sheets stored therein to the image forming portion 102 at predetermined timing concurrently with the image forming operation described above. When the sheet is fed to the image forming portion 102, the toner images of the respective colors formed on the photosensitive drums 102*a* through 102*d* are transferred to the sheet to form a non-fixed toner image on the sheet. After that, as the sheet is conveyed to the fixing portion 103 provided downstream of the image forming portion 102 in a sheet conveying direction, the non-fixed toner image is fixed in the fixing portion 103 and the sheet is sent to the finisher 500 by a pair of discharge rollers 104.

Note that in a case of double face printing, the sheet is reversed by reversing rollers 105, and the reversed sheet is conveyed again to the image forming portion 102 by conveyor rollers 106*a* through 106*f* provided on a reverse conveying path to repeat the abovementioned image forming operation.

The finisher 500 is connected downstream of the pair of discharging rollers 104 in the discharge direction and is configured to receive a plurality of sheets sent from the copier 100 and to be able to perform sheet processing or the like based on setting and others input from the operating portion 601.

As shown in FIG. 2, the sheet sent from the copier 100 is passed first to a pair of inlet rollers 501 provided upstream of a sheet conveying path 542 included in a body 540 of the finisher 500. At this time, an inlet sensor not shown concurrently detects the sheet passing timing. The sheet passed to the pair of inlet rollers 501 is then conveyed to a pair of conveying rollers 502 and a transverse registration detecting unit 300 to detect a transverse registration error in a sheet widthwise direction orthogonal to the sheet discharge direction. When the transverse registration detecting unit 300 detects a transverse registration error, a shift unit 400 performs a shift operation of moving the sheet by a predetermined amount. It is noted that the transverse registration detecting unit 300 and the shift unit 400 will be described later in detail.

After that, the sheet is conveyed sequentially through the sheet conveying path by pairs of conveying rollers 506 through 508. Then, a change-over flapper 509 changes over the conveying direction of the sheet to convey to an upper stacking tray 515 or to a lower stacking tray 516 disposed at a position vertically different from the position of the upper stacking tray 515. When the change-over flapper 509 is changed over to the side of the upper stacking tray 515 for example, the sheet is discharged onto the upper stacking tray 515 by a pair of discharge rollers 510. When the change-over flapper 509 is changed over to the side of the lower stacking tray 516 in contrary, the sheet is conveyed sequentially by pairs of conveying rollers 511 through 513 to be discharged onto the lower stacking tray 516 by a pair of discharge rollers 514. That is, the pairs of discharge rollers (sheet discharging portion) 510 and 514 are provided respectively at downstream ends of the sheet conveying path 542 bifurcated so that sheets can be sorted, and discharge the sheet conveyed through the sheet conveying path 542 to the outside of the body 540 of the finisher 500.

It is noted that a stapler 580 is provided along the sheet conveying path 542 on the side of discharging the sheet to the lower stacking tray 516. A plurality of sheets is stapled by the stapler 580 and is discharged onto the lower stacking tray 516 when a stapling process is performed. When no stapling process is required, the sheet is discharged directly onto the lower stacking tray 516 by passing through a bypassing path. Thus, the finisher 500 includes sheet processing portions such as the change-over flapper 509 and the stapler 580 described above and is configured to implement various processes such as the sorting and stapling processes to the sheet sent to the body 540 thereof.

The upper stacking tray 515 is attached to an outer wall surface 541 of the body 540 such that the tray 515 declines toward the outer wall surface 541. The outer wall surface 541 of the body 540 constitutes an abutting member 550 under the pair of discharge rollers 510. Therefore, the sheet discharged onto the upper stacking tray 515 moves upstream in the discharge direction on a stacking surface 515*a* declined upstream in the discharge direction along the inclination of the stacking surface 515*a* by its own weight. Then, as an upstream end in the discharge direction of the sheet abuts against the abutting member 550 and stops, the sheet is aligned in the discharge direction. When the sheet is aligned in the discharge direction, the sheet is then aligned in the width direction by the upper tray aligning portion 517. In the same manner, the lower stacking tray 516 is attached to the outer wall surface 541 of the body 540 under the upper stacking tray 515 such that the tray 516 declines toward the outer wall surface 541. The outer wall surface 541 of the body 540 also constitutes an abutting member 551 under the pair of discharge rollers 514. Therefore, the sheet discharged onto the lower stacking tray 516 moves upstream in the discharge direction on a stacking surface 516*a* declined upstream in the discharge direction along the inclination of the stacking surface 516*a* by its own weight. Then, as an upstream end in the discharge direction of the sheet abuts against the abutting member 551 and stops, the sheet is aligned in the discharge direction. When the sheet is aligned in the discharge direction, the sheet is then aligned in the width direction by the lower tray aligning portion 518. It is noted that the stacking surfaces of the upper and lower stacking trays 515 and 516 are made of synthetic resin such as plastics, and generate a predetermined friction force with a sheet, which is greater than a friction force between sheets for example.

Figure 3:
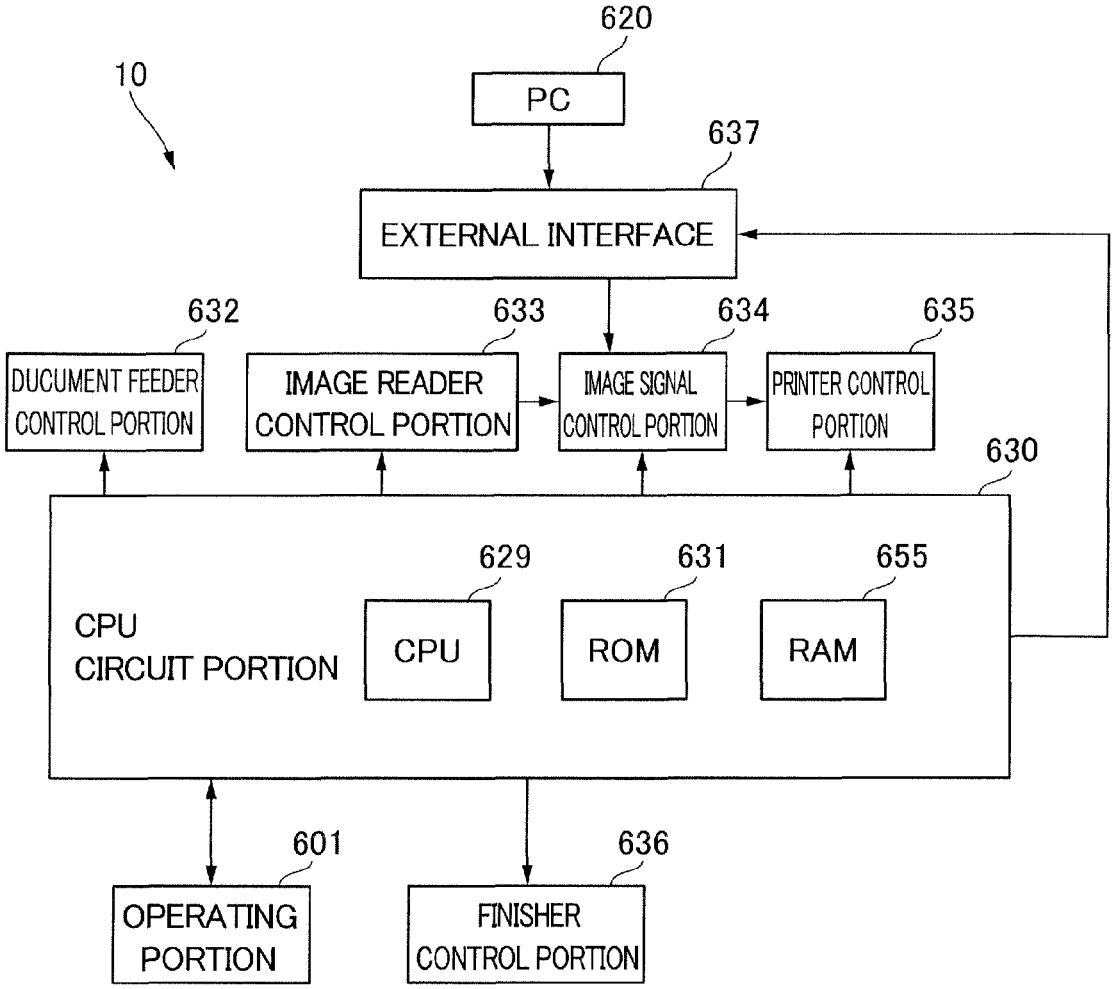
FIG. 3 is a block diagram of a control portion configured to control the multifunction printer of the embodiment.
Figure 4:
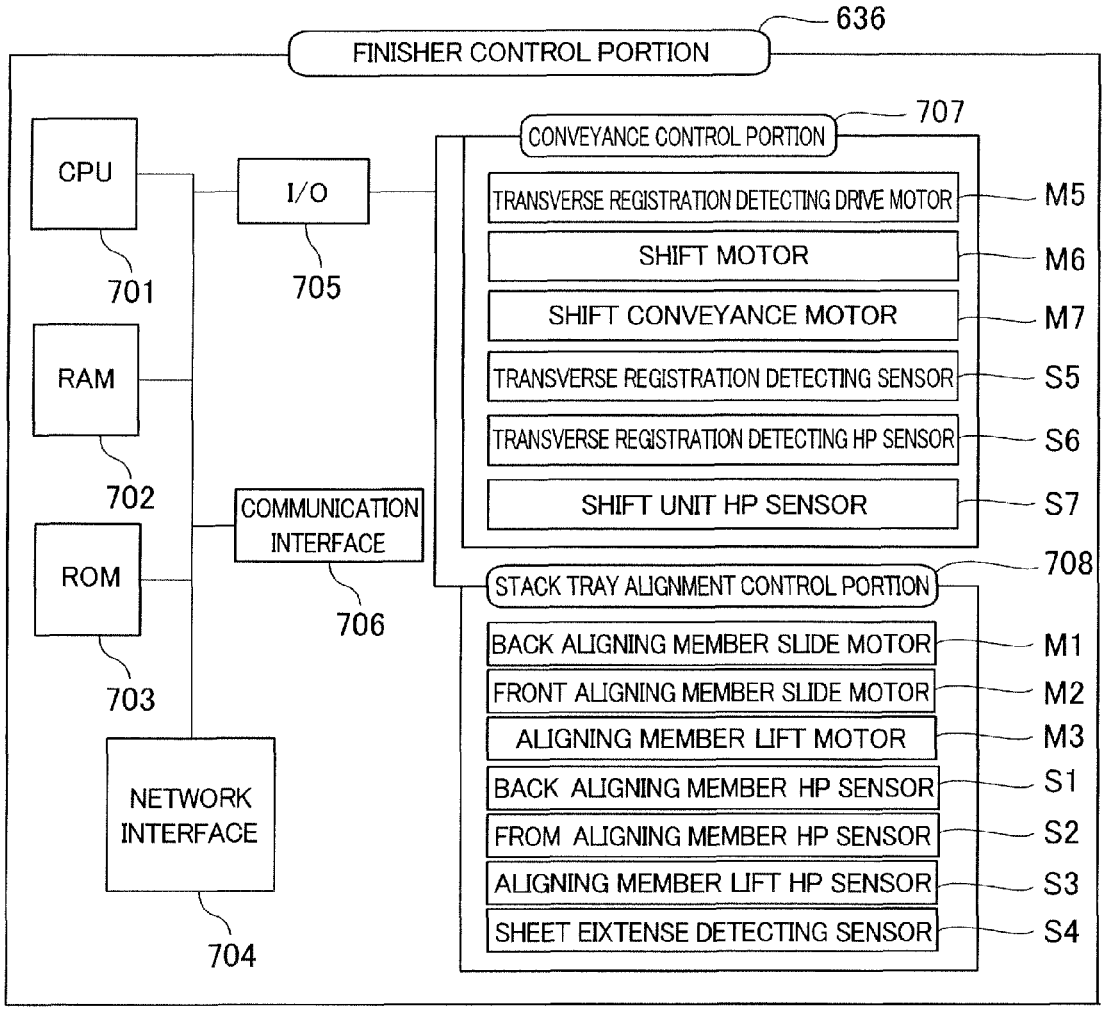
FIG. 4 is a block diagram of a finisher control portion configured to control the finisher of the embodiment.

A control portion 10 of the multifunction printer 1 of the present embodiment will now be described with reference to FIGS. 3 and 4. FIG. 3 is a block diagram showing the control portion 10 of the multifunction printer 1 of the embodiment, and FIG. 4 is a block diagram showing a finisher control portion 636 configured to control the finisher 500 of the embodiment.

As shown in FIG. 3, the control portion 10 includes a CPU circuit portion 630, a document feeder control portion 632, an image reader control portion 633, an image signal control portion 634, a printer control portion 635, and the finisher control portion 636. In the present embodiment, the CPU circuit portion 630, the document feeder control portion 632, the image reader control portion 633, the image signal control portion 634, and the printer control portion 635 are installed in the copier 100, and the finisher control portion 636 is installed in the finisher 500.

The CPU circuit portion 630 includes a CPU 629, a ROM 631, and a RAM 655. The CPU 629 controls the document feeder control portion 632, the image reader control portion 633, the image signal control portion 634, the printer control portion 635, and the finisher control portion 636 in accordance to programs stored in the ROM 631 and to setting input from the operating portion 601. The RAM 655 is used as an area for temporarily holding control data and as a working area of calculations involved in the controls.

The document feeder control portion 632 controls the document feeding portion 107*a*, and the image reader control portion 633 controls the document reading portion 107*b* that reads information of a document fed from the document feeding portion 107*a* (see FIG. 1). The image reader control portion 633 outputs data of the read document to the image signal control portion 634. The printer control portion 635 controls the copier 100. An external interface 637 connects an external computer (PC) 620 with the copier 100, and decompresses print data input from the outside computer (PC) 620 as an image to output to the image signal control portion 634 for example. The image data output to the image signal control portion 634 is output to the printer control portion 635 to form an image in the image forming portion 102.

As shown in FIG. 4, the finisher control portion 636 includes a CPU (microcomputer) 701, a RAM 702, a ROM 703, an input/output portion (I/O) 705, a communication interface 706, and a network interface 704. The finisher control portion 636 also includes a conveyance control portion 707 and a stacking tray alignment control portion 708. The finisher control portion 636 is configured to be able to execute controls such as a sheet discharging operation described later of the finisher 500 by controlling various drive motors and sensors shown in FIG. 4 by exchanging information with the CPU control portion 630. For instance, the finisher control portion 636 executes a skew reducing control described later made to reduce a skew of a sheet discharged out of the pair of discharge rollers 510 (514) and an alignment control described later made to align the sheet in the width direction. The finisher control portion 636 composes the sheet stacking apparatus 560 that stacks sheets together with the stacking trays 515 and 516, sheet presence/absence detecting sensors (each sensor referred to as a "sheet presence detecting sensor" hereinafter) 70 and 71, aligning portions 517 and 518, and abutting members 550 and 551 (see also FIG. 2).

Figure 5:
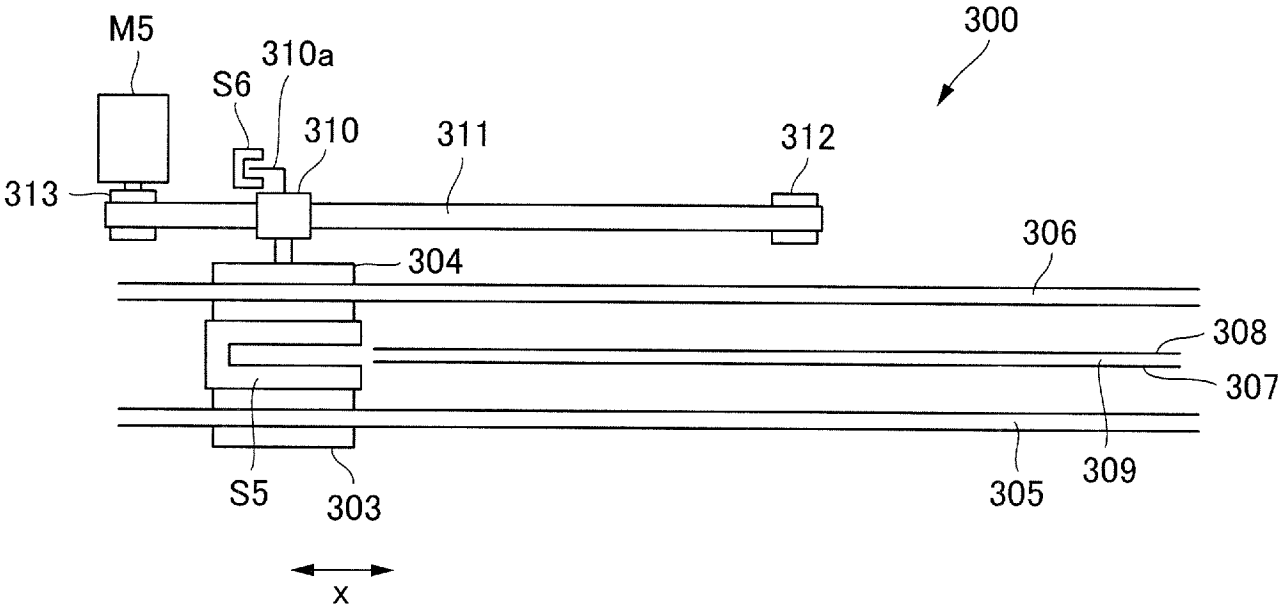
FIG. 5 is a section view of a transverse registration detecting unit of the finisher of the embodiment viewed from a downstream side.

Next, the transverse registration detecting unit 300 of the finisher 500 of the present embodiment will be described with reference to FIG. 5. FIG. 5 is a section view of the transverse registration detecting unit 300 of the finisher 500 of the embodiment viewed from a downstream side.

As shown in FIG. 5, the transverse registration detecting unit 300 specifies position of a widthwise end of a sheet by detecting the end of the sheet passing through a sheet conveying path 309 formed by a pair of conveying guides 307 and 308 by a transverse registration detecting sensor S5. The transverse registration detecting sensor S5 is supported by bearings 303 and 304, which are in turn supported by guides 305 and 306 fixed to the finisher 500 movably in the width direction X as indicated in FIG. 5. The bearings 303 and 304 are connected to a timing belt 311 through an intermediary of a locking plate 310. The timing belt 311 is wrapped around a pulley 312 supported by the finisher 500 and a pulley 313 connected to the transverse registration detecting drive motor M5.

The transverse registration detecting sensor S5 determines a home position thereof by detecting a locking plate flag 310*a* provided on the locking plate 310 by a transverse registration detecting HP sensor S6 attached to the finisher 500. Then, the transverse registration detecting sensor S5 moves to a position corresponding to a sheet size in advance from the home position based on sheet size information input from the operating portion 601 of the copier 100, and specifies the position of the widthwise end of the sheet by detecting the position of the widthwise end of the sheet entering a concave portion of the sensor S5.

Figure 6:
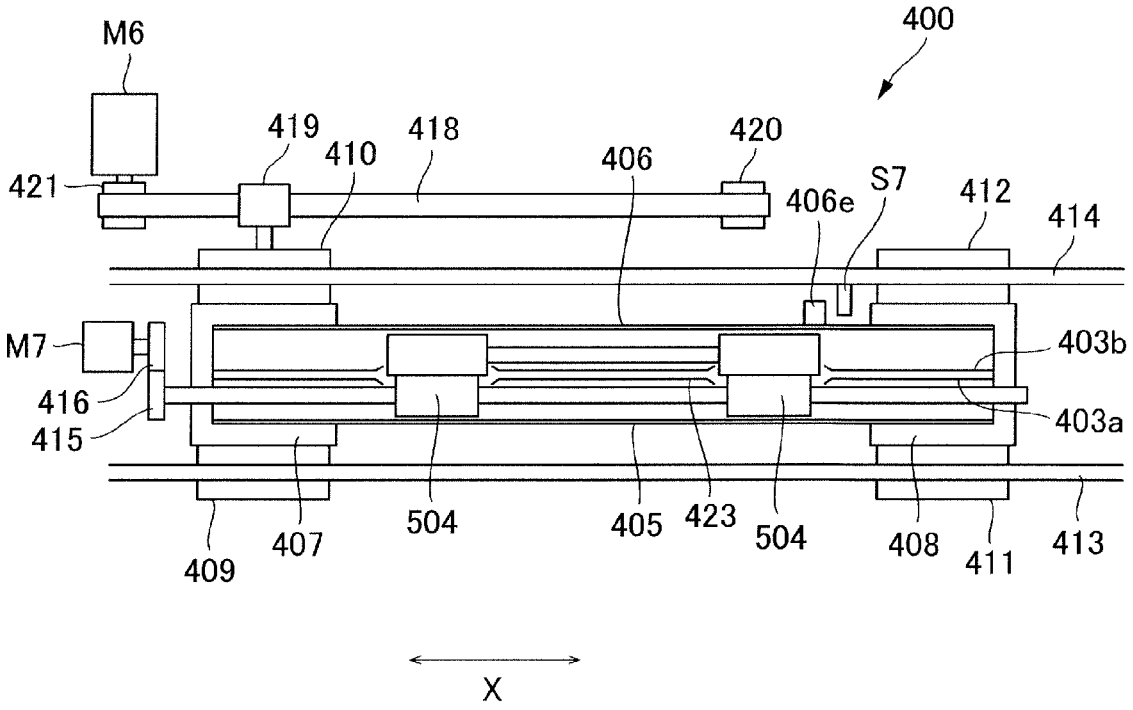
FIG. 6 is a section view of a shift unit of the finisher of the embodiment viewed from the downstream side.

Next, the shift unit 400 of the finisher 500 will be described with reference to FIGS. 2 and 6. FIG. 6 is a section view of the shaft unit 400 of the finisher 500 of the embodiment viewed from the downstream side.

As shown in FIGS. 2 and 6, the shift unit 400 is configured such that a sheet conveyed by pairs of conveying rollers 503 and 504 passes through a conveying path 423 formed by a pair of conveying guides 403*a* and 403*b*. The pairs of conveying rollers 503 and 504 are connected to a shift conveying motor M7 through gears 415 and 416 such that the pair of rollers 503 and 504 can rotate normally and reversely in accordance to rotation of the shift conveying motor M7. It is noted that the pairs of conveying rollers 503 and 504 as well as the conveying guides 403*a* and 403*b* are supported by frames 405 through 408. Bearings 409 through 412 are fixed to the frames 405 through 408. The bearings 409 through 412 are supported by guides 413 and 414 to be movable in the width direction X indicated in FIG. 6. The bearings 409 through 412 are connected to a timing belt 418 through an intermediary of a locking plate 419. The timing belt 418 is wrapped around a pulley 420 supported by the finisher 500 and a pulley 421 connected to a shift motor M6.

The shift unit 400 determines home positions of the frames 405 through 408 by detecting a flag portion 406*e* provided on the frame 406 that moves in the width direction X indicated in FIG. 6 by a shift unit HP sensor S7 attached to the finisher 500. Then, the shift unit 400 moves the sheet in the width direction by moving the frames 405 through 408 from the home position to a position corresponding to a transverse registration error. That is, the shift unit 400 is disposed upstream of the pairs of discharge rollers 510 and 514 along the sheet conveying path 542 to adjust the widthwise position of the sheet to be discharged out of the pairs of discharge rollers 510 and 514.

Figure 7A:
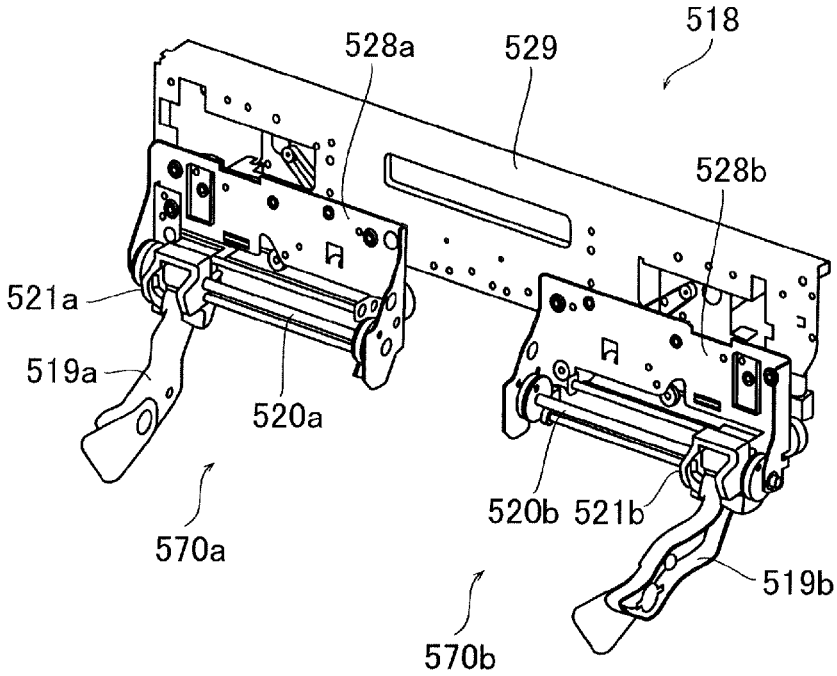
FIG. 7A is a perspective view of a lower tray aligning portion of the finisher of the embodiment viewed from a front side.
Figure 7B:
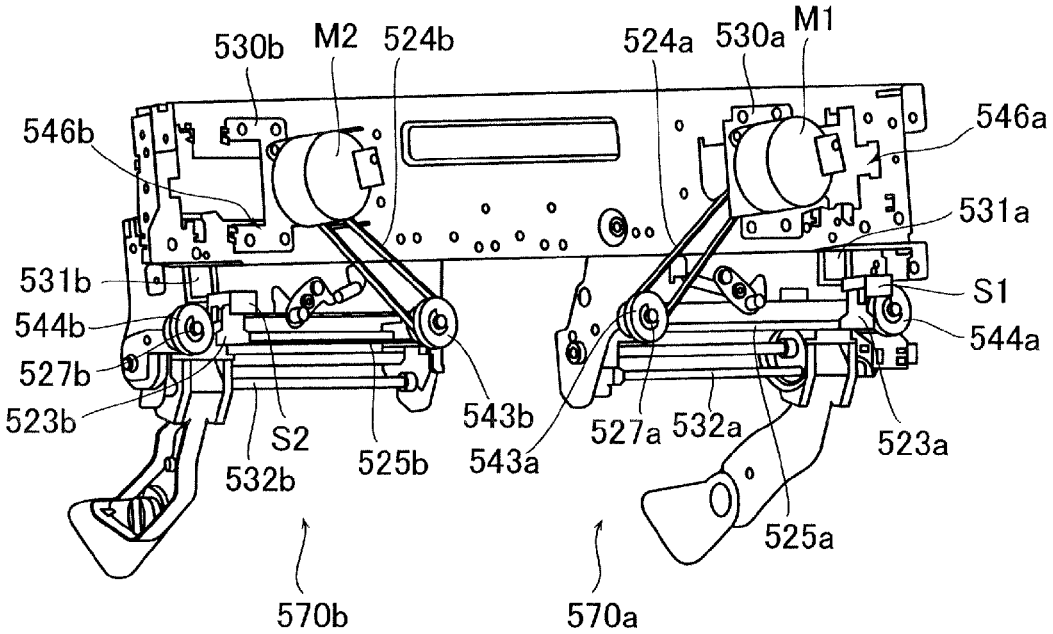
FIG. 7B is perspective view of the lower tray aligning portion of the finisher of the embodiment viewed from the back side.

Next, upper and lower tray aligning portions 517 and 518 that respectively constitute an aligning portion of the present embodiment will be described with reference to FIGS. 7 through 9 in addition to FIG. 2. Firstly, structures of the upper and lower tray aligning portions 517 and 518 will be described with reference to FIGS. 7A and 7B. It is noted that because the basic structures of the upper and lower tray aligning portions 517 and 518 are the same except that the upper tray aligning portion 517 is provided above the upper stacking tray 515 and that the lower tray aligning portion 518 is provided above the lower stacking tray 516, the description will be made on the lower tray aligning portion 518 here and an overlapped description of the upper tray aligning portion 517 will be omitted. It is also noted that the width direction will be referred to also as a front-back direction hereinafter. FIGS. 7A and 7B are perspective views showing the lower tray aligning portion 518 of the finisher 500 of the embodiment, respectively.

As shown in FIG. 2, the lower tray aligning portion 518 is provided below the upper stacking tray 515 and above the lower stacking tray 516. As shown also in FIGS. 7A and 7B, the lower tray aligning portion 518 includes a front aligning unit 570*b* disposed on the front side as one side, a back aligning unit 570*a* disposed on the back side as another side, and an upper stay 529. The front and back aligning units 570*b* and 570*a* are attached to the upper stay 529 symmetrically in the front and back directions, i.e., in the width direction. The upper stay 529 is supported by the finisher 500.

The front aligning unit 570*b* includes a front aligning member 519*b* as a first aligning member, a pulley supporting plate 528*b*, a front aligning member sliding motor M2, and a front aligning member HP sensor S2. The back aligning unit 570*a* also includes a back aligning member 519*a* as a second aligning member, a pulley supporting plate 528*a*, a back aligning member sliding motor M1, and a back aligning member HP sensor S1. It is noted that because the basic structures of the front and back aligning units 570*b* and 570*a* are the same, only the structure of the back aligning unit 570*a* will be described here and the description of the front aligning unit 570*b*, whose members are denoted by corresponding reference numerals, will be omitted.

A base end portion of the back aligning member 519*a* is supported by a sliding member 521*a*. The sliding member 521*a* is rotatably and slidably supported by a first alignment spindle 520*a* as a center of rotation thereof. The sliding member 521*a* also pinches a second sliding drive transmission belt 525*a* with a slide position detecting member 523*a*. The second sliding drive transmission belt 525*a* are wrapped around a pair of slide drive transmission pulleys 543*a* and 544*a*. The sliding drive transmission pulley 543*a* is rotatably supported by a pulley spindle 527*a* which is coupled by caulking with a pulley supporting plate 528*a*. The sliding drive transmission pulley 543*a* which is formed to be also a stepped pulley engages also with a first slide driving transmission belt 524*a*. The first slide driving transmission belt 524*a* is engaged with the back aligning member sliding motor M1. The back aligning member 519*a* moves in the front and back directions as the sliding member 521*a* slides along the first alignment spindle 520*a* by being driven by the back aligning member sliding motor M1 to cause an aligning face of an edge portion thereof come into contact with the widthwise end of the sheet.

The pulley supporting plate 528*a* is attached to the upper stay 529, and the back aligning member sliding motor M1 is mounted on the upper stay 529 through an intermediary of a sliding drive motor supporting plate 530*a*. The back aligning member HP sensor S1 is mounted on the upper stay 529 through an intermediary of an aligning position detecting support plate 531*a* to detect a home position of the back aligning member 519*a*. It is noted that the front aligning member HP sensor S2 is also mounted on the upper stay 529 through an intermediary of an aligning position detecting support plate 531*b*, forming a pair between the back aligning member 519*a* and the front aligning member 519*b*.

Thus, the back aligning member sliding motor M1, the sliding member 521*a* that slides the back aligning member 519*a*, the transmission mechanism that transmits power of the back aligning member sliding motor M1 to the sliding member 521*a*, the back aligning member HP sensor S1 and others described above compose a back aligning member sliding mechanism 546*a*. In the same manner, a front aligning member sliding motor M2, a sliding member 521*b* that slides a front aligning member 519*b*, a transmission mechanism that transmits power of the front aligning member sliding motor M2 to a sliding member 521*b*, a front aligning member HP sensor S2 and others described above compose a front aligning member sliding mechanism 546*b*. Thus, the lower tray aligning portion 518 composes the aligning mechanism that moves the back and front aligning members 519*a* and 519*b* by these back and front aligning member sliding mechanisms 546*a* and 546*b*. The lower tray aligning portion 518 aligns a sheet by sandwiching it between the aligning faces of the back and front aligning members 519*a* and 519*b* by sliding the pair of aligning members 519*a* and 519*b* in the width direction by a predetermined distance by the aligning mechanism.

Besides the back and front aligning member sliding mechanisms 546*a* and 546*b*, the lower tray aligning portion 518 includes a lifting/lowering mechanism (referred to as a "lifting mechanism" hereinafter) that lifts and lowers the back and front aligning members 519*a* and 519*b*. While this lifting mechanism is also composed of a back aligning member lifting mechanism 547*a* that lifts the back aligning member 519*a* and a front aligning member lifting mechanism 547*b* that lifts the front aligning member 519*b*, similarly to the sliding mechanisms 546*a* and 546*b*, only the back aligning member lifting mechanism 547*a* of the back aligning unit 570*a* will be described here because their basic structures are the same as described above.

Figure 8A:
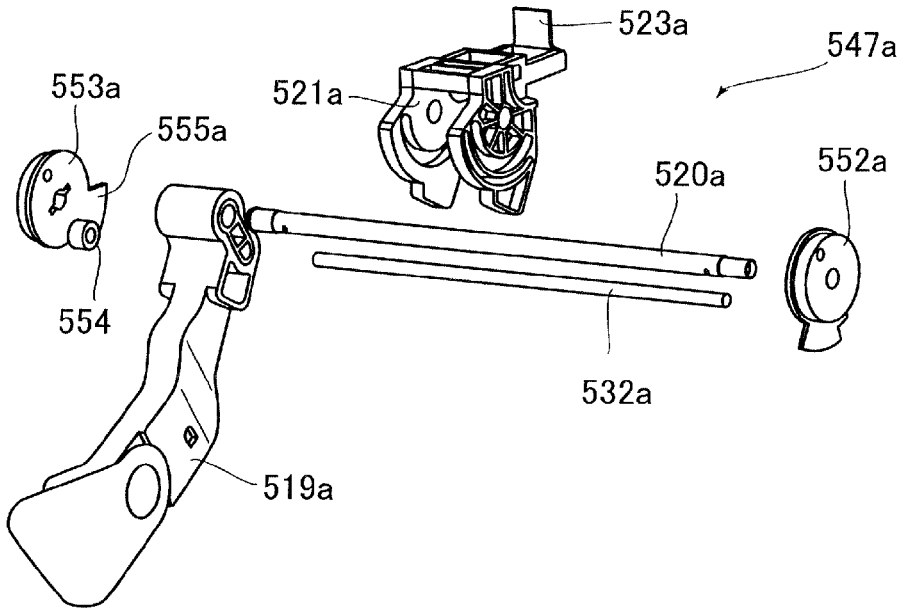
FIG. 8A is an exploded perspective view of a lifting mechanism of the embodiment.
Figure 8B:
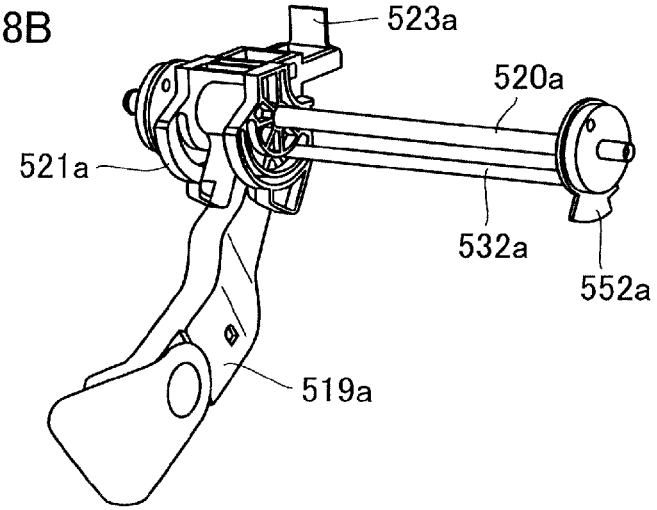
FIG. 8B is a perspective view of the lifting/lowering mechanism of FIG. 8A in a state in which an aligning member is lowered.
Figure 8C:
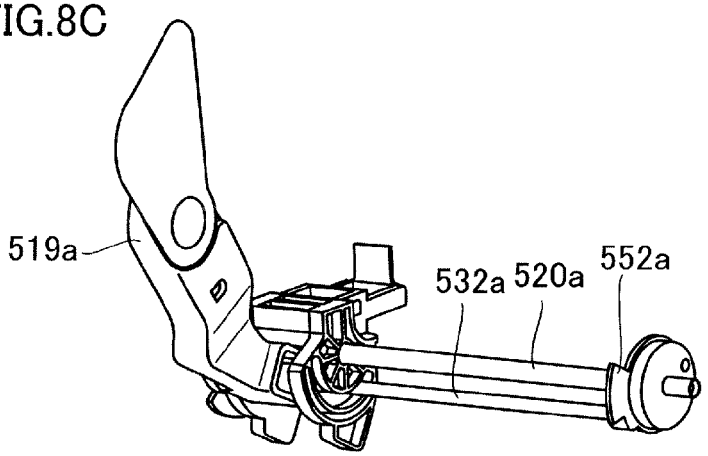
FIG. 8C is a perspective view of the lifting/lowering mechanism of FIG. 8A in a state in which the aligning member is lifted.
Figure 9A:
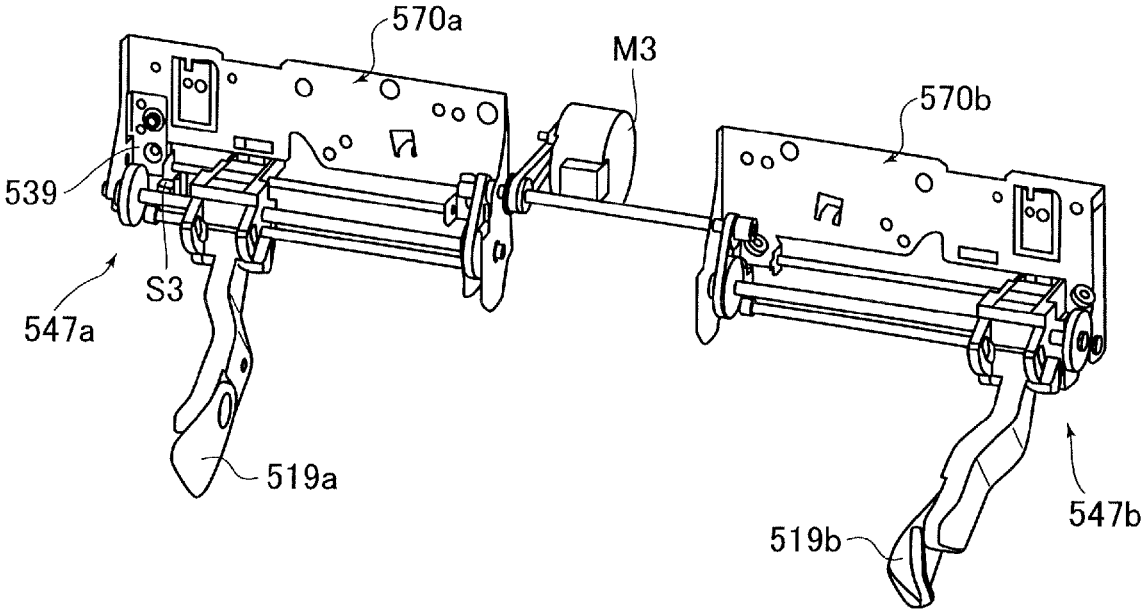
FIG. 9A is a perspective view of a driving mechanism configured to drive the lifting/lowering mechanism that lifts the aligning member of the embodiment.
Figure 9B:
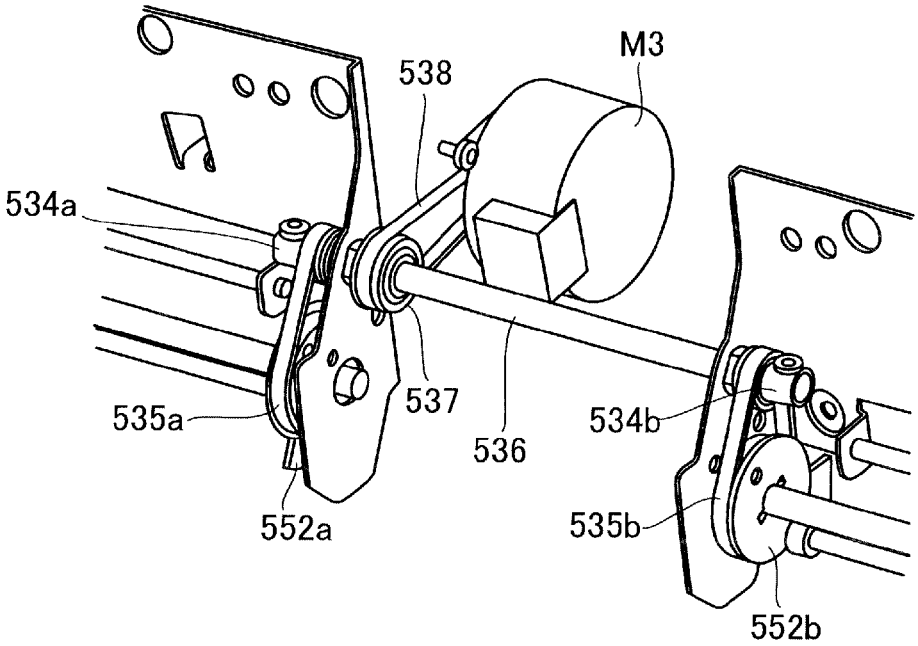
FIG. 9B is an enlarged view of a main part of the driving mechanism in FIG. 9A.

FIGS. 8A through 8C are perspective views for explaining structures and operations of the lifting mechanism of the back aligning member 519*a* of the lower tray aligning portion 518 of the embodiment, and FIGS. 9A and 9B are perspective views of a driving mechanism that drives the lifting mechanism of the back aligning member 519*a* of the embodiment. As shown in FIGS. 8A and 8B, the back aligning member 519*a* supported by the first alignment spindle 520*a* is engaged also with a second alignment spindle 532*a*, i.e., a rotation stopper. The second alignment spindle 532*a* is supported by a pair of aligning member lifting pulleys 552*a* and 553*a* such that both ends of the spindle 532*a* are fitted into hole portions 554 of the pulleys. The pair of aligning member lifting pulleys 552*a* and 553*a* also support both ends of the first alignment spindle 520*a*. When the pair of aligning member lifting pulleys 552*a* and 553*a* rotate centering on the first alignment spindle 520*a*, the second alignment spindle 532*a* also rotationally moves centering on the first alignment spindle 520*a*. Because the back aligning member 519*a* is engaged with the second alignment spindle 532*a* as described above, the back aligning member 519*a* rotates and lifts when the second alignment spindle 532*a* rotationally moves (see FIG. 8C). Thus, the back aligning member lifting mechanism 547*a* is configured to rotate the back aligning member 519*a* through the second alignment spindle 532*a*.

As shown also in FIGS. 9A and 9B, the front-side aligning member lifting pulley 552*a* is connected to a second lifting pulley 534*a* through an intermediary of a drive transmission belt 535*a*. The second lifting pulley 534*a* is fitted into an end of a lift transmission shaft 536 cut into a shape of D to be connected with the lift transmission shaft 536. A third lifting pulley 537 is also connected to the lift transmission shaft 536. The third lifting pulley 537 is connected with the aligning member lifting motor M3 through an intermediary of a drive transmission belt 538. With this arrangement, a drive of the aligning member lifting motor M3 is transmitted to the back aligning member 519*a* so that the lifting operation of the back aligning member 519*a* is carried out.

When the pair of aligning member lifting pulleys 552*a* and 553*a* rotates at this time, a flag portion 555*a* of the aligning member lifting pulley 552*a* turns On/Off the aligning member lifting HP sensor S3 that detects a lift position of the back aligning member 519*a*. Thus, it is possible to detect the lift position of the back aligning member 519*a*, i.e., to detect specifically whether the back aligning member 519*a* is located at a receiving position where the back aligning member 519*a* can execute a sheet aligning operation or at a setback position where the back aligning member 519*a* does not restrict widthwise positions of the sheet. The back aligning member 519*a* is controlled based on the detected result of the sensor S3. The drive of the aligning member lifting motor M3 is thus transmitted to the back aligning member 519*a* to lift and to control rotation and position.

The lift transmission shaft 536 is connected also with a second lifting pulley 534*b* of a front aligning member lifting mechanism 547*b* on another end opposite from the end to which the second lifting pulley 534*a* of the back aligning member lifting mechanism 547*a* is connected. Therefore, the power of the aligning member lifting motor M3 is transmitted also to the front aligning member lifting mechanism 547*b*, so that the front aligning member 519*b* can be lifted in synchronism with the back aligning member 519*a*. The lifting mechanism is thus constructed by including the back and front aligning member lifting mechanisms 547*a* and 547*b*, and the aligning member lifting motor M3 which is a common driving source of the back and front aligning member lifting mechanisms 547*b* and 547*a*.

The sheet is stacked on the lower stacking tray 516 while being aligned in the width direction by the back and front aligning members 519*a* and 519*b* through the operations described above. Then, after stacking a predetermined number of sheets specified by the user, i.e., after finishing the job, the back and front aligning members 519*a* and 519*b* are turned upward to set back from the receiving position to the setback position.

Next, sheet presence detecting sensors 70 and 71 that detect whether the sheet is present or absent on the stacking surfaces of the upper and lower stacking trays 515 and 516 of the finisher 500 of the present embodiment will be described with reference to FIG. 10.

It is noted that a configuration of the sheet presence detecting sensor 71 of the upper stacking tray 515 is the same with that of the sheet presence detecting sensor 70 of the lower stacking tray 516. Therefore, the following description of the configuration of the sheet presence detecting sensor will be made concerning the sheet presence detecting sensor 70 attached to the lower stacking tray 516, and the description of the sheet presence detecting sensor 71 of the upper stacking tray 515 will be omitted here.

Figure 10A:
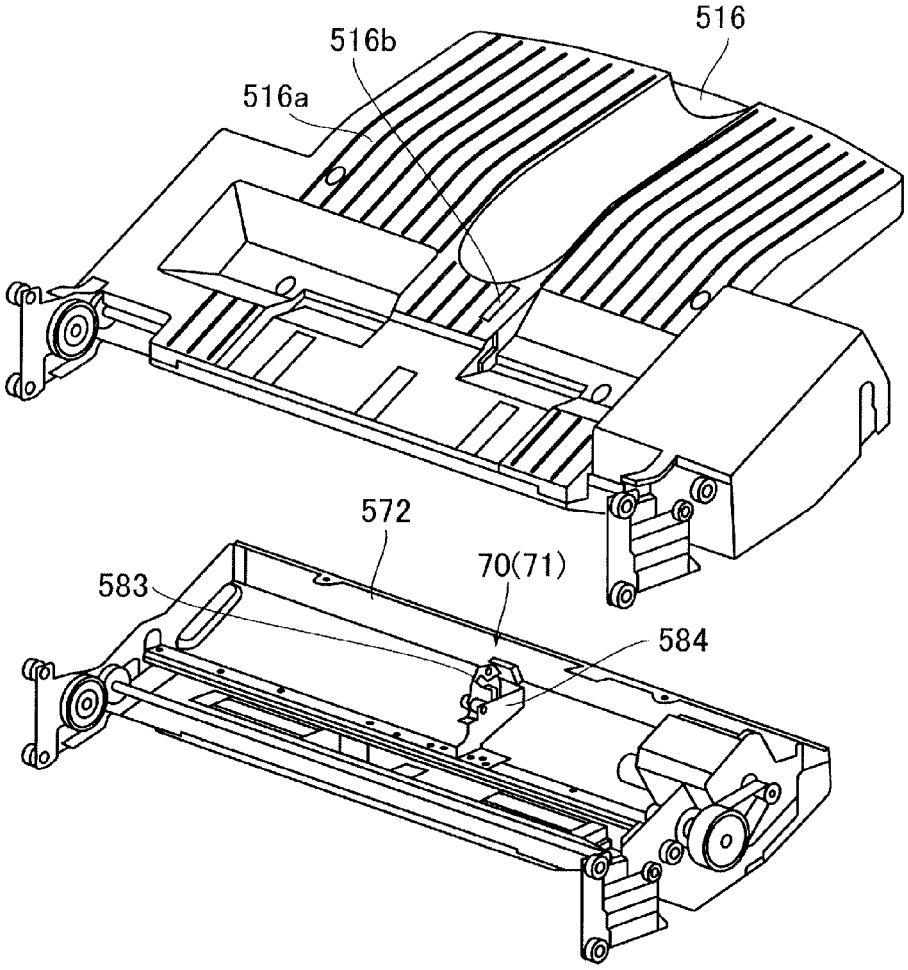
FIG. 10A is an exploded perspective view illustrating a structure around a lower stacking tray of the finisher of the embodiment.
Figure 10B:
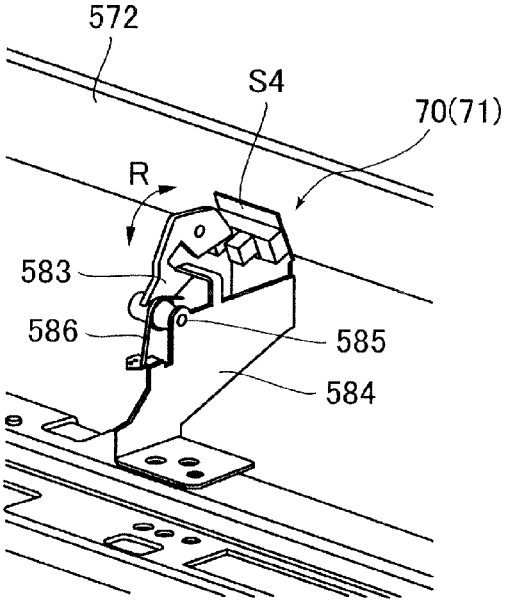
FIG. 10B is a perspective view schematically showing a structure of a sheet presence/absence detecting sensor shown in FIG. 10A.

FIG. 10A is a perspective exploded view showing the lower stacking tray 516 of the finisher 500 of the embodiment. As shown in FIG. 10A, an opening 516*b* through which a sheet presence detecting flag 583 projects is provided on a stacking surface 516*a* of the lower stacking tray 516. The sheet presence detecting flag 583 is attached to a base plate 572 through an intermediary of a sheet presence detecting plate 584. The sheet presence detecting flag 583 is supported rotatably in a direction of an arrow R shown in FIG. 10B centering on a flag rotational shaft 585 caulked to the sheet presence detecting plate 584 and is urged to project as shown in FIG. 10B by a rotational spring 586.

When the sheet presence detecting flag 583 projects out, a photo sensor S4 is turned off and a stacking tray alignment control portion 708 determines that there is no sheet on the stacking surface 516*a* of the lower stacking tray 516. When the stacking tray alignment control portion 708 determines that there is no sheet, a skew reducing control is executed as described later. When a sheet is stacked on the lower stacking tray 516 in contrary, the sheet presence detecting flag 583 turns due to weight of the sheet, the photo sensor S4 is turned on, and the stacking tray alignment control portion 708 determines that the sheet is being stacked, i.e., the sheet exists, on the lower stacking tray 516. When the stacking tray alignment control portion 708 determines presence of the sheet, the alignment control is executed as described later. Thus, the sheet presence detecting sensor (71) includes the sheet presence detecting flag 583, the photo sensor S4 and others and detects whether the sheet is present or absent on the stacking surface 516*a* by turning on/off the photo sensor S4 by the sheet presence detecting flag 583 that turns by the weight of the sheet existing on the stacking surface 516*a*. The skew reducing or alignment control is executed based on the detected result of the sheet presence detecting sensor 70 (71).

Figure 11:
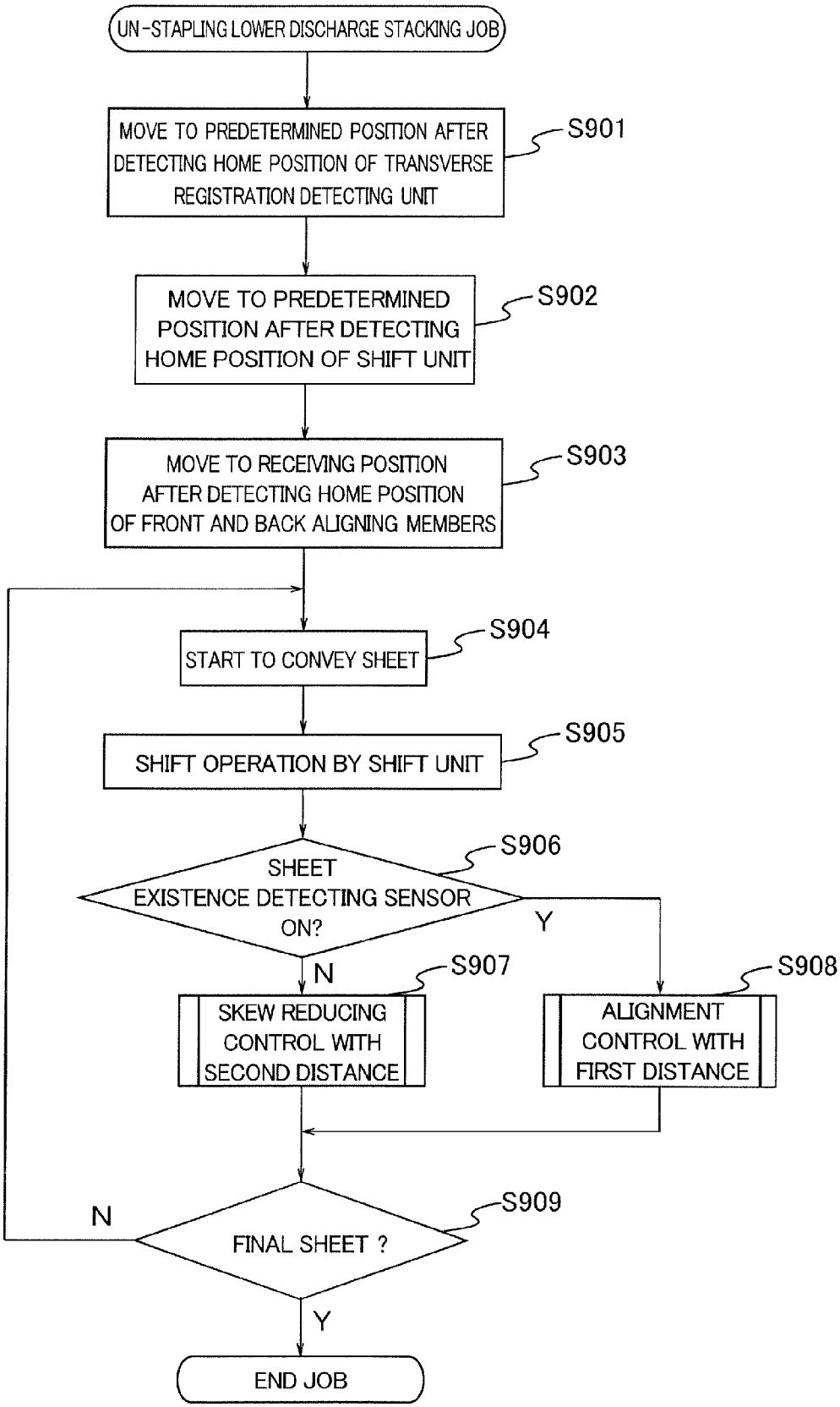
FIG. 11 is a flowchart showing sheet aligning operations of the embodiment.

Next, a sheet discharging operation of the finisher 500 in discharging a plurality of sheets having the same size to the lower stacking tray 516 will be described along a flowchart shown in FIG. 11 and with reference to FIG. 12. FIG. 11 is a flowchart showing sheet aligning operations performed by the lower tray aligning portion 518 of the finisher 500 of the embodiment. FIGS. 12A through 12D are diagrams illustrating the motions of the front and back aligning members 519*b* and 519*a* in the skew reducing control and the alignment control made by the finisher control portion 636 of the embodiment. It is noted that the sheet aligning operations, i.e., the skew reducing and alignment controls, also apply to the case when a sheet is discharged to the upper tray aligning portion 517.

When the user sets a non-stapling lower discharge stacking mode and starts the job, the finisher control portion 636 drives the transverse registration detecting drive motor M5 first to detect a home position of the transverse registration detecting sensor S5 and moves the transverse registration detecting sensor S5 to a predetermined position corresponding to a sheet size in Step S901. It is noted the predetermined position corresponding to the sheet size to which the transverse registration detecting sensor S5 moves is a position set in advance based on sheet size information input from the operating portion 601, and the transverse registration detecting sensor S5 is moved to the predetermined position by being driven by the transverse registration detecting drive motor M5 by a predetermined amount.

In the same manner, the finisher control portion 636 drives the shift conveying motor M7 to detect home positions of the frames 405 through 408 of the shift unit 400, and moves the frames 405 through 408 from the home positions to the predetermined positions corresponding to the sheet size in Step S902. It is noted that the predetermined positions corresponding to the sheet size to which the frames 405 through 408 are moved are positions set in advance based on the sheet size information input from the operating portion 601, and the frames 405 through 408 are moved to the predetermined positions by being driven by the shift conveying motor M7 by a predetermined amount.

In response to the move of the transverse registration detecting sensor S5 and the frames 405 through 408 to the predetermined positions, the finisher control portion 636 moves the front and back aligning members 519*b* and 519*a* respectively to the home positions after initially actuating them. The front aligning member HP sensor S2, the back aligning member HP sensor S1 and the aligning member lifting HP sensor S3 detect the home positions, and the moves to the home positions are carried out by driving and controlling the front aligning member sliding motor M2, the back aligning member sliding motor M1 and the aligning member lifting motor M3.

Figure 12A:
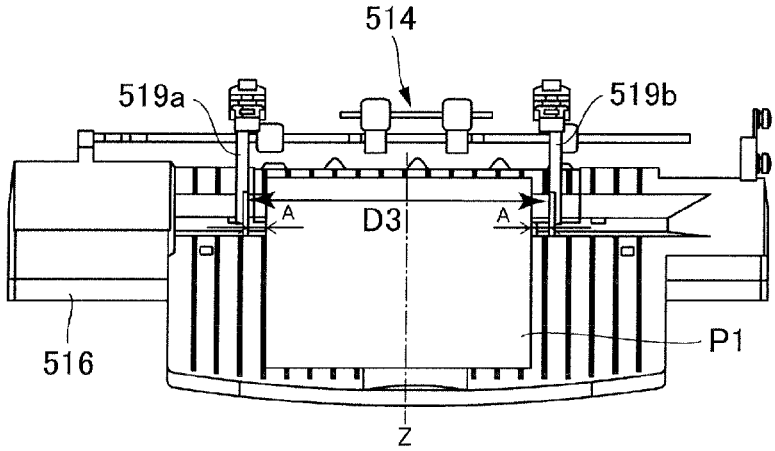
FIG. 12A is a diagram illustrating a condition of the front and back aligning members in receiving a sheet in a skew reducing control operation.

When the front and back aligning members 519*b* and 519*a* move to the home positions, the finisher control portion 636 moves the front and back aligning members 519*b* and 519*a* from the setback position where the aligning members do not align a sheet to the receiving position in Step S903. The receiving position is a position of level enabling to discharge a sheet between the back and front aligning members 519*b* and 519*a* (the pair of aligning members) located on the stacking surface 516*a* and a widthwise position where the sheet is not hindered to be discharged onto the stacking surface 516*a*. As shown in FIG. 12A, the lower tray aligning portion 518 is set such that clearances of a distance A are generated between the sheet P1 discharged onto the lower stacking tray 516 and the back and front aligning members 519*a* and 519*b*, respectively, in the present embodiment. Distances between alignment surfaces of the back and front aligning members 519*a* and 519*b* of this time is set to be a third distance D3 which is wider than a second distance D2 described later. That is, the back and front aligning members 519*a* and 519*b* stand by respectively at the receiving position spaced by the clearances of the distance A to the widthwise ends of the sheet. While the distance A is set to be 5 mm in the present embodiment, the distance is not limited to that distance and may be appropriately set in accordance to a size, i.e., widthwise length, of a sheet to be aligned and to an inclination of the sheet predicted from discharge speed and others.

When the front and back aligning members 519*b* and 519*a* move to the receiving position, conveyance of a first sheet P1 is started in Step S904. When the sheet P1 which has been selectively fed from the cassette 101*a* or 101*b* and on which an image has been formed by the image forming portion 102 is sent to the body 540 of the finisher 500, a transverse registration error of the sheet P1 is detected by the transverse registration detecting sensor S5. When the transverse registration detecting unit 300 detects a transfer registration error, the shift unit 400 carries out the shift operation of moving the sheet P1 in the width direction such that the sheet P1 is adjusted with the aligning position in the sheet width direction of the pair of aligning members in Step S905. In a case when a shift mode of shifting sheets in the width direction to sort per each bundle of sheets is preset here, a total shift amount in which a distance to be shifted is added to the transverse registration error is determined, and the shift operation is carried out based on the shift amount. The sheet P1 is shifted by a correction amount of the transverse registration error so that the sheet P1 is discharged near a position (widthwise conveyance center Z) aligned by the front and back aligning members 519*b* and 519*a*.

When the sheet P1 is sent into the finisher 500, the stacking tray alignment control portion 708 determines whether the sheet is present or absent on the lower stacking tray 516 in Step S906. In a case when the sheet presence detecting sensor 70 (S4) is OFF here, it is determined that there is no sheet on the stacking surface 516*a* of the lower stacking tray 516, i.e., No in Step S906, and the skew reducing control is executed in Step S907. It is noted that the skew reducing control is a control of executing operations of aligning a position of the sheet P1 discharged onto the stacking surface 516*a*, which is determined to have no sheet thereon, by the front and back aligning members 519*b* and 519*a* to be closer to an aligned condition within a range not hindering the move of the sheet P1 to the abutting member 551.

Specifically, the front and back aligning members 519*b* and 519*a* are moved from the setback position to the receiving position before the sheet P1 is discharged onto the stacking surface 516*a* as described above and are held at the receiving position for a predetermined period of time also after when the sheet P1 is discharged onto the stacking surface 516*a* (see FIG. 12A). This predetermined time is preset based on a standard time from when the sheet P1 is discharged onto the stacking surface 516*a* until when the sheet P1 abuts against the abutting member 551. During when the front and back aligning members 519*b* and 519*a* are located at the receiving position, the sheet P1 enters at least between the aligning faces of the front and back aligning members 519*b* and 519*a*.

Figure 12B:
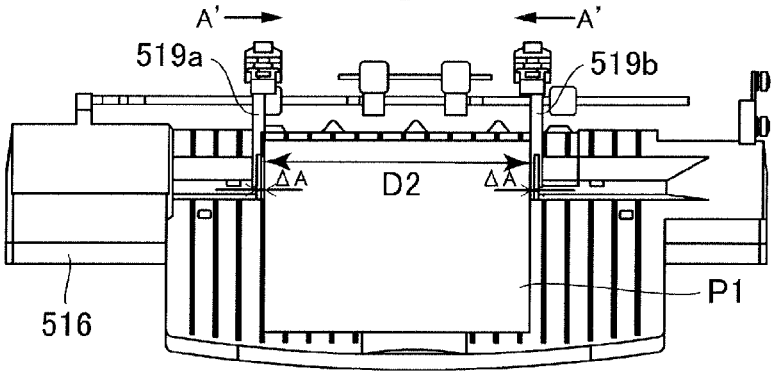
FIG. 12B is a diagram illustrating a condition of the front and back aligning members in reducing a skew of the sheet.

Then, as the predetermined time elapses, the front and back aligning members 519*b* and 519*a* are moved in directions approaching with each other (inner side in the width direction) by a distance A' whose direction is indicated each in FIG. 12B. Here, the distance A' is shorter than the distance A (A>A') and generates a clearance ΔA between the respective aligning faces of the front and back aligning members 519*b* and 519*a* and the widthwise end of the sheet, where A−A'=ΔA. In the present embodiment, ΔA is preset to be 0.5 mm as a clearance between the widthwise end of a sheet and the aligning face that does not hinder the move of the first sheet P1 toward the abutting member 551. A distance between the aligning faces of the front and back aligning members 519*b* and 519*a* at this time is set to be a second distance D2 which is wider than a first distance D1 by a predetermined distance as detailed below. The second distance D2 of the present embodiment is preset to be a distance wider than a widthwise length of the sheet P1 to be aligned by 0.5 mm each on the both sides, i.e., by 1 mm in total. That is, the second distance D2 is preset to be a distance in the sheet width direction that restricts an inclination angle of the sheet discharged onto the stacking tray 516(515) to be equal to or less than a predetermined angle. It is noted that the clearance between the widthwise end of the sheet and the aligning face is preferable to be in a range between 0.3 mm to 1.0 mm by taking a parts machining error, assembly accuracy, variation of widthwise length of sheets and others into consideration. The distance of 0.5 mm is one exemplary case.

As the skew reducing control is executed, the front and back aligning members 519*b* and 519*a* come in contact with the both widthwise ends of a sheet if it is discharged in a condition skewed more than a predetermined degree with respect to the sheet discharge direction, so that the skew of the sheet is reduced. Still further, because the front and back aligning members 519*b* and 519*a* do not sandwich the sheet even if the skew reducing control is executed, the move of the sheet P1 toward the abutting member 551 is not hindered. Even if the (downward) move of the sheet on the stacking surface 516*a* is delayed due to a high kinetic friction force or the like after being discharged onto the stacking surface 516*a*, the sheet P1 will not stop on its way because the front and back aligning members 519*b* and 519*a* do not abut the both widthwise ends of the sheet P1. It is also possible to set a width of a degree of freedom in a sheet plane direction (width of inclination) by setting a degree of ΔA.

Figure 12C:
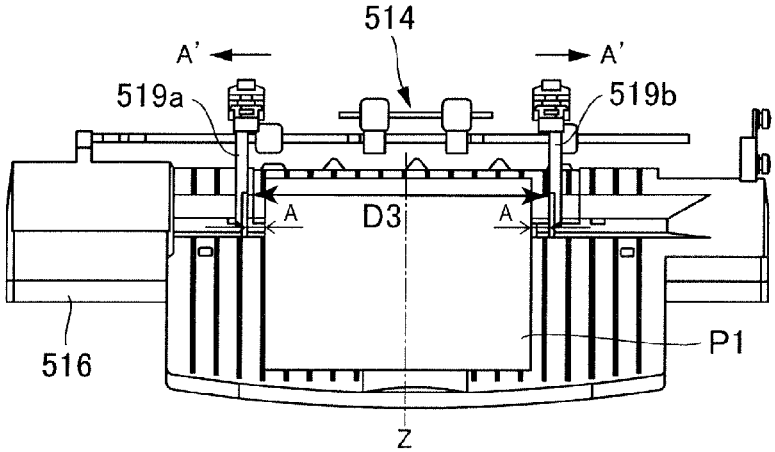
FIG. 12C is a diagram illustrating a condition of the front and back aligning members in receiving a sheet in a both-side aligning control operation.

When the skew reducing control ends, the front and back aligning members 519*b* and 519*a* are moved by the distance A' each in directions away from each other as shown in FIG. 12C to return and let the front and back aligning members 519*b* and 519*a* stand by at the receiving position. When the discharged sheet P1 is a final sheet of the job, the non-stapling lower discharge stacking mode is finished. When the sheet is not a final sheet, the flow returns to Step S904.

Figure 12D:
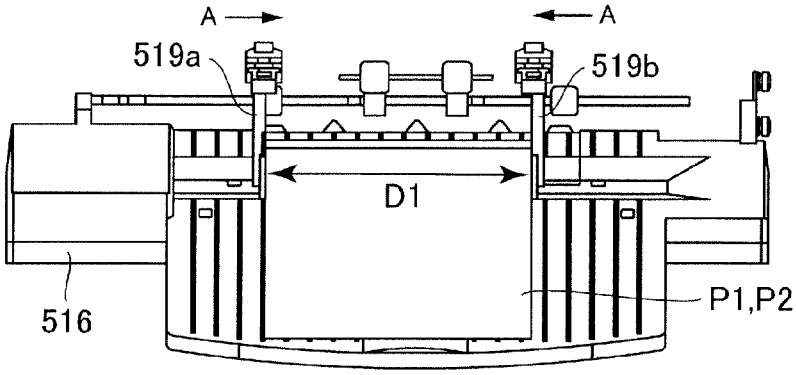
FIG. 12D is a diagram illustrating a condition of the front and back aligning members in aligned the sheet in the both-side aligning control operation.

In a case when the sheet presence detecting sensor 70 is ON due to a sheet already stacked when a succeeding sheet P2 is conveyed next to the sheet P1 for example, the finisher control portion 636 determines that there is a sheet, e.g., the sheet P1, on the stacking surface 516*a* of the lower stacking tray 516, i.e., Yes in Step S906, and executes the aligning control in Step S908. Specifically, when the sheet P2 is discharged on the stacking surface 516*a*, the finisher control portion 636 moves the front and back aligning members 519*b* and 519*a* at the receiving position in the directions approaching with each other as shown in FIG. 12D, i.e., the inner sides in the width direction, by the distance A after an elapse of a predetermined time. That is, the front and back aligning members 519*b* and 519*a* are abutted the both widthwise ends of the sheet P2. With this arrangement, the sheet P2 on the stacking surface 516*a* is held by the front and back aligning members 519*b* and 519*a* and is aligned in the width direction together with the sheet P1 already stacked.

It is noted that a distance between the aligning faces of the front and back aligning members 519*b* and 519*a* in aligning the sheet P2 on the stacking surface 516*a* at this time is preset to be the first distance D1 described above corresponding to the widthwise length of the sheet P2 to be aligned. Still further, although the first distance D1 of the present embodiment is preset to be almost equal to the widthwise length of the sheet P2 of the sheet P2 to be aligned, the distance may be preset to be narrower than the widthwise length of the sheet more or less to align the sheet P while bending the sheet P. That is, the first distance D1 is preset to be equal to or less the widthwise length of the sheet discharged onto the stacking surface. When the aligning control ends, the finisher control portion 636 moves the front and back aligning members 519*b* and 519*a* in the directions separating away from each other by the distance A to return the aligning members 519*b* and 519*a* to the receiving position shown in FIG. 12A so that the front and back aligning members 519*b* and 519*a* stand by there. If the discharged sheet P2 is a final sheet of the job, the non-stapling lower discharge stacking mode is finished. If the sheet P2 is not a final sheet, the flow returns to Step S904 to repeat the abovementioned steps.

As described above, the finisher 500 of the present embodiment executes the skew reducing control with the second distance D2 when there is no sheet on the stacking surface 516*a*, and executes the aligning control with the first distance D1 when there is a sheet on the stacking surface 516*a*. Therefore, even if the moving speed of the sheet P1 is delayed due to the high kinetic friction force between the sheet P1 and the stacking surface 516*a*, the sheet P1 will not be stopped by being held by the front and back aligning members 519*b* and 519*a*. Thereby, the sheet P1 can move until when it abuts against the abutting member 551 and can be aligned in the discharge direction. As a result, it is possible to prevent an occurrence of stacking misalignment of the sheets in the discharge direction.

For instance, it is possible to abut a sheet against an abutting member even in an environment in which a high kinetic friction force is apt to be generated between a coated paper and a stacking surface of a stacking tray in a high-temperature and high-humidity environment where it is difficult to move the sheet to the abutting member.

Still further, even if a sheet is discharged out of the pair of discharge rollers 514 askew, it is possible to reduce the skew of the sheet by the skew reducing control with the second distance D2. Therefore, because the skew is reduced even in a condition in which moving failure or the like is apt to be caused in aligning the sheet in the width direction due to the static friction force with the stacking surface, it is possible to prevent widthwise stacking misalignment otherwise from occurring due to the moving failure or the like in executing the alignment control. It is also possible to correct a reduced skew of the sheet P1 already stacked.

While the embodiment of the invention has been described above, the invention is not limited to the embodiment described above. Still further, the effects described in the embodiment of the invention are merely an enumeration of the most preferable effects brought about from the invention, so that the effects of the invention are not limited only to those described in the embodiment of the invention.

For instance, while the front and back aligning members 519*b* and 519*a* are driven to carry out the operation of aligning the sheet P2 widthwise in executing the aligning control operation with the first distance D1 with the judgment that the sheet exists in the embodiment described above, the invention is not limited to such operation. The aligning control operation with the first distance D1 may be carried out by setting the shift mode and by using one-side alignment in which the second sheet P2 and thereafter are aligned in the width direction by driving only the back aligning member 519*a* while fixing the front aligning member 519*b*.

Figure 13A:
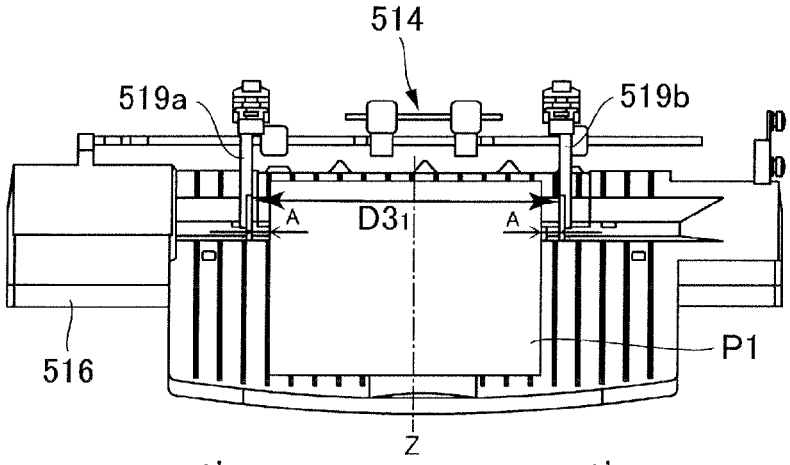
FIG. 13A is a diagram illustrating a condition of the front and back aligning members in receiving a sheet in the skew reducing control operation.
Figure 13B:
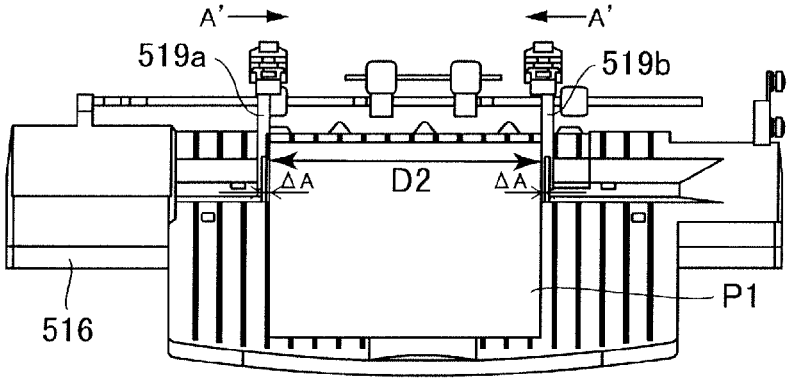
FIG. 13B is a diagram illustrating a condition of the front and back aligning members in reducing a skew of the sheet.
Figure 13C:
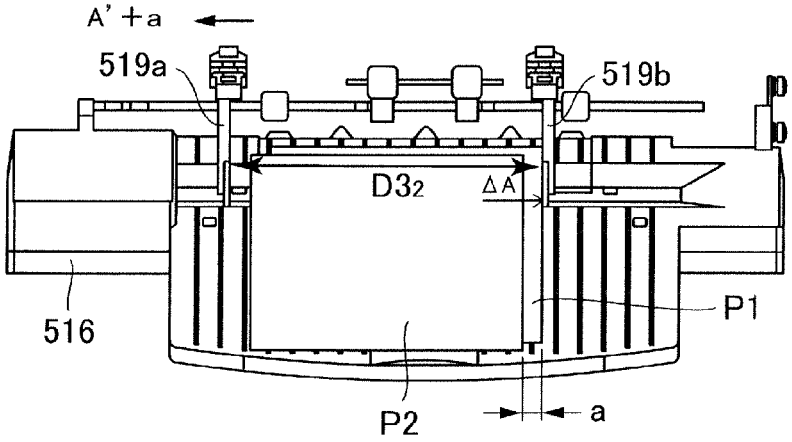
FIG. 13C is a diagram illustrating a condition of the front and back aligning members in receiving a sheet in one-side aligning control operation.

Here, the one-side alignment operation in the case when the shift mode is set will be described with reference to FIG. 13. It is noted that because the operations for aligning the first sheet P1 shown in FIGS. 13A and 13B are the same with those of the embodiment described above shown in FIGS. 12A and 12B, their description will be omitted here. In a case when the shift mode is set and the one-side alignment of the second sheet and thereafter is to be carried out, the front aligning member 519*b* is held there and the back aligning member 519*a* is set back by a distance (A'+a) after finishing the skew reducing control operation of the sheet P1 with the second distance D2. Next, the transverse registration detecting sensor S5 detects a transverse registration error of the second sheet P2 and the shift unit 400 carries out a shift operation of moving the sheet P2 by a predetermined amount. The sheet P2 is shifted to the back side by the shift unit 400 more than sheet P1 by a predetermined distance (a) and is discharged to a position distant to the back side more than sheet P1 by the predetermined distance (a) as shown in FIG. 13C in the present embodiment.

Figure 13D:
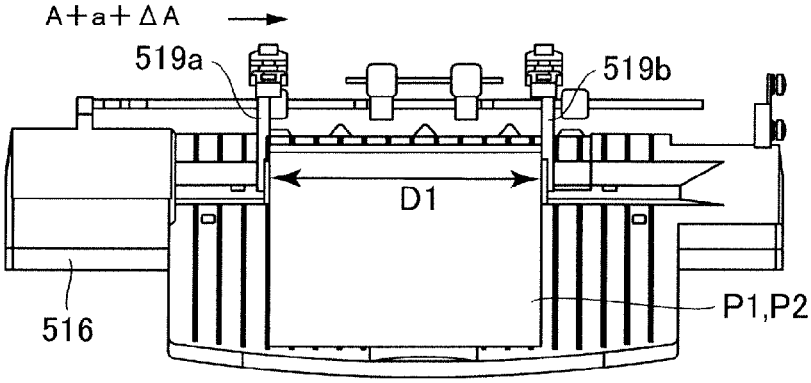
FIG. 13D is a diagram illustrating a condition of the front and back aligning members in aligning the sheet in the one-side aligning control operation.

When the sheet P2 is discharged back more than an alignment position by the predetermined distance (a), the one-side alignment from the back is carried out by moving the back aligning member 519*a* toward the front aligning member 519*b* by a distance (A+a+ΔA) as shown in FIG. 13D. At this time, the first sheet P1 is located at a position distant from the fixed front aligning member 519*b* by a slight clearance, e.g., 0.5 mm, and will not be moved to the final stacking position from the position deviated by the predetermined distance (a), like the sheet P2. That is, it is possible to reduce the sheet P1 from skewing otherwise caused when the first sheet P1 sticks with the lower stacking tray 516, because the widthwise moving distance on the lower stacking tray 516 is small. When the one-side alignment of the front and back aligning members 519*b* and 519*a* is finished by moving the back aligning member 519*a*, the front aligning member 519*b* to which the front side ends of the sheets P1 and P2 are held there and the back aligning member 519*a* is set back. Then, if the sheet P2 is not a final sheet, the abovementioned steps are repeated. If the sheet P2 is a final sheet, the front aligning member 519*b* is set back to the front side and the job is ended. Thus, the use of the one-side alignment allows the sheet already stacked to be aligned while preventing misalignment thereof.

It is noted that because the widthwise discharge position of the second sheet P2 and thereafter is shifted from that of the first sheet P1 by the predetermined amount, a distance (third distance) D3 between the aligning faces of the back and front aligning members 519*a* and 519*b* at the receiving position is changed as a distance $D3_1$ in the case of the first sheet P1 and a distance $D3_2$ in the case of the second sheet P and thereafter. However, the third distance $D3_1$ in the skew reducing operation may be equalized with the third distance $D3_2$ in the one-side alignment operation.

Still further, although the abovementioned embodiment has been described by using the configuration in which the abutting member is provided at the upstream end of the stacking tray whose stacking surface is declined to the upstream side of the discharge direction, the invention is not limited also to that configuration. For instance, the present invention is also operative even in a configuration in which an abutting member is provided at a downstream end of a stacking tray whose stacking surface is declined to a downstream side in the discharge direction. The present embodiment has been also described by using the configuration in which a sheet moves along the inclination of the stacking surface on the inclined stacking surface of the stacking tray by its own weight, the invention is not limited to such configuration. For instance, the present invention is applicable also to a case of using a moving unit that moves a sheet toward the abutting member, because there is a case when it becomes difficult to move the sheet again when it is stopped until when the sheet slides along the inclination of the stacking surface to a position where the sheet can be moved by the moving unit.

The finisher control portion 636 is installed in the finisher 500 and is controlled by the CPU circuit portion 630 installed in the copier 100 connected online with each other in the configuration of the embodiment, the present invention is not limited to such configuration. For instance, the finisher control portion 636 may be installed integrally with the CPU circuit portion 630 in the copier 100 and the finisher 500 may be controlled from the copier 100 side.

The configuration of the slide and lifting mechanisms of the aligning portions 517 and 518 is not also limited to that described above. For instance, the aligning portions may be moved in the width and vertical directions by using rails, and may be configured by using any known mechanism such as a rack and pinion, cams, links or the like.

The sheet stacking apparatus of the invention may not be necessary to be always installed in the finisher, and may be used as a large-capacity sheet stocker. The sheet stacking apparatus may be used not only for aligning a sheet on a discharge tray to which the sheet is discharged out of the finisher as described above in the embodiment, but also for aligning a sheet on a processing tray for carrying out a stapling process within a finisher. The image forming apparatus in which the abovementioned sheet stacking apparatus is installed is not also limited to be the color multifunction printer of the present embodiment, and is applicable to a copier, a printer, a facsimile, monochrome multifunction printer, or the like. That is, the sheet stacking apparatus of the invention is applicable to any apparatus as long as the apparatus aligns a sheet on a tray in the width direction.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2012-103010, filed on Apr. 27, 2012, and of Japanese Patent Application No. 2013-079260, filed on Apr. 5, 2013 which are hereby incorporated by reference herein in its entirety.

What is claimed is:

1. A sheet stacking apparatus comprising:

a sheet discharging portion configured to discharge a plurality of sheets;

a stacking portion having a stacking surface on which each sheet discharged from the sheet discharging portion is stacked;

a sheet presence/absence detecting portion that detects whether a sheet is present or absent on the stacking surface of the stacking portion;

an abutting portion against which each end in a sheet discharge direction of the sheets discharged by the sheet discharging portion and stacked on the stacking surface abuts;

an alignment mechanism including a pair of aligning members respectively having aligning faces that align the sheets discharged onto the stacking surface in a sheet width direction; and a control portion that controls the aligning mechanism based on a detected result of the sheet presence/absence detecting portion indicating a presence of the sheet on the stacking surface of the stacking portion such that a distance between the aligning faces of the pair of aligning members is set as a first distance, and controls the aligning mechanism based on a detected result of the sheet presence/absence detecting portion indicating an absence of the sheet on the stacking surface of the stacking portion such that the distance between the aligning faces of the pair of aligning members is set as a second distance, the second distance being wider than the first distance and being wider than a widthwise length of the sheet discharged onto the stacking surface.

2. The sheet stacking apparatus according to claim 1, wherein the second distance is a distance in the sheet width direction that restricts an inclination angle of the sheet to be equal to or less than a predetermined angle.

3. The sheet stacking apparatus according to claim 1, wherein the first distance is equal to or less than the widthwise length of each sheet discharged onto the stacking surface.

4. The sheet stacking apparatus according to claim 1, wherein the control portion controls the aligning mechanism such that the distance between the aligning faces of the pair of aligning members becomes a third distance which is wider than the second distance before the sheet is discharged onto the stacking surface, and after keeping the third distance for a predetermined period of time, moves the aligning mechanism such that the distance between the aligning faces of the pair of aligning members becomes the first or second distance based on the detected result of the sheet presence/absence detecting portion.

5. The sheet stacking apparatus according to claim 4, wherein the predetermine period of time is set based on a time from when the sheet is discharged onto the stacking surface until when the sheet abuts against the abutting member.

6. The sheet stacking apparatus according to claim 4, further comprising a lifting/lowering mechanism configured to lift and lower the pair of aligning members;

wherein the control portion controls the lifting/lowering mechanism to move the pair of aligning members from a setback position in which no alignment is made to a position of level capable of receiving the sheet to be discharged between the pair of aligning members before the sheet is discharged onto the stacking surface.

7. The sheet stacking apparatus according to claim 4, wherein the control portion controls the aligning mechanism to change the distance between the aligning faces of the pair of aligning members from the third distance to the first distance by moving each of the pair of aligning members.

8. The sheet stacking apparatus according to claim 4, wherein the control portion controls the aligning mechanism to change the distance between the aligning faces of the pair of aligning members from the third distance to the first distance by moving one of the pair of aligning members while fixing the other one.

9. The sheet stacking apparatus according to claim 1, further comprising a lifting/lowering mechanism configured to lift and lower the pair of aligning members.

10. The sheet stacking apparatus according to claim 9, wherein the control portion controls the lifting/lowering mechanism to move the pair of aligning members from a setback position in which no alignment is made to a position of level capable of receiving the sheet to be discharged between the pair of aligning members before the sheet is discharged onto the stacking surface.

11. The sheet stacking apparatus according to claim 1, further comprising:

a shift unit disposed upstream of a sheet conveying path more than the sheet discharging portion and adjusting a widthwise position of each sheet to be discharged out of the sheet discharging portion;

wherein the control portion controls the shift unit to adjust such that the widthwise position of each sheet to be discharged conforms to a widthwise aligning position of the pair of aligning members.

12. A sheet processing apparatus comprising:

the sheet stacking apparatus according to claim 1; and a body including a sheet processing portion to which a sheet on which an image has been formed is sent and which processes the sheet thus sent.

13. The sheet processing apparatus according to claim 12, wherein the sheet discharging portion is provided at a downstream end of a sheet conveying path and discharging the sheet conveyed through the sheet conveying path out of the body;

the stacking portion includes a stacking tray and the stacking tray is attached to an outer wall surface of the body such that the stacking tray is declined toward the outer wall surface; and the abutting member is composed of the outer wall surface of the body.

14. The sheet processing apparatus according to claim 13, further comprising a shift unit disposed upstream of the sheet conveying path more than the sheet discharging portion and adjusting a widthwise position of the sheet to be discharged out of the sheet discharging portion;

wherein the control portion controls the shift unit to adjust such that the widthwise position of the sheet to be discharged conforms to the widthwise aligning position of the pair of aligning members.

15. The sheet processing apparatus according to claim 13, further comprising a lifting/lowering mechanism configured to lift and lower the pair of aligning members.

16. The sheet stacking apparatus according to claim 1, wherein the control portion controls the alignment mechanism such that the distance between the aligning faces of the pair of aligning members is set as the first distance to align the plurality of sheets stacked on the stacking surface from the state in which the distance between the stacking surface of the pair of aligning members is set as a third distance wider than the second distance.

17. The sheet stacking apparatus according to claim 1, wherein the stacking surface is inclined and the abutting member abuts against each end of the sheets moving along the inclination of the stacking surface.

18. The sheet stacking apparatus according to claim 1, wherein the stacking portion includes a stacking tray having the stacking surface and the sheet presence/absence detecting portion is provided on the stacking tray.

19. A sheet stacking apparatus according to claim 1, wherein the pair of aligning members aligns a sheet discharged onto a sheet already stacked on the stacking surface with the sheet already stacked by the distance between the aligning faces of the pair of aligning members set into the first distance in response to the detected result of the sheet presence/absence detecting portion indicating the presence of the sheet on the stacking surface by the control portion, and wherein the pair of aligning members restricts a position of the sheet discharged onto the stacking surface on which no sheet is present by the distance between the aligning faces of the pair of aligning members set into the second distance in response to the detected result of the sheet presence/absence detecting portion indicating the absence of the sheet on the stacking surface by the control portion.

20. A sheet stacking apparatus comprising:

a sheet discharging portion configured to discharge a plurality of sheets;

a stacking surface on which each sheet discharged from the sheet discharging portion is stacked;

a sheet detecting portion detecting a sheet on the stacking surface;

an abutting portion against which each end in the sheet discharge direction of the sheets on the stacking surface abuts;

an alignment portion including a pair of aligning members respectively having aligning faces that align the sheets on the stacking surface in a sheet width direction in parallel with the end of the sheet abutting against the abutting portion; and a control portion controlling the alignment portion such that a distance between the aligning faces of the pair of aligning members is set as a first distance to align a sheet discharged on a sheet already stacked on the stacking surface from a state in which the distance between the aligning surface of the pair of aligning members is set as a predetermined distance wider than the first distance, and the distance between the aligning faces of the pair of aligning members is set as a second distance which is wider than the first distance and narrower than the predetermined distance to restrict a position of a first sheet discharged to the stacking surface in a state that the control portion determines that no sheet is present on the stacking surface on a basis of a detected result of the sheet detecting portion.

21. The sheet stacking apparatus according to claim 20, wherein the control portion controls the aligning portion such that the pair of aligning members is moved to a receiving position in which the distance between the aligning faces of the pair of aligning members is the predetermined distance and which permits to receive the sheet between the pair of aligning members before the sheet is discharged onto the stacking surface, and such that the distance between the aligning faces of the pair of aligning members becomes from the receiving position to the first or second distance based on a detected result of the sheet detecting portion.

22. The sheet stacking apparatus according to claim 20, further comprising a stacking tray having the stacking surface, wherein the sheet detecting portion is provided on the stacking tray.

23. An image forming apparatus comprising:

a image forming portion configured to form an image on a sheet;

a sheet discharging portion configured to discharge a plurality of sheets on which the images have been formed by the image forming portion;

a stacking portion having a stacking surface on which each sheet discharged from the sheet discharging portion is stacked;

a sheet presence/absence detecting portion that detects whether a sheet is present or absent on the stacking surface of the stacking portion;

an abutting member against which each end in a sheet discharge direction of the sheets which are discharged by the sheet discharging portion and stacked on the stacking surface abuts;

an alignment mechanism including a pair of aligning members respectively having aligning faces that align the sheets discharged onto the stacking surface in a sheet width direction; and a control portion that controls the aligning mechanism based on a detected result of the sheet presence/absence detecting portion indicating a presence of the sheet on the stacking surface of the stacking portion such that a distance between the aligning faces of the pair of aligning members is set as a first distance, and controls the aligning mechanism based on a detected result of the sheet presence/absence detecting portion indicating an absence of the sheet on the stacking surface of the stacking portion such that the distance between the aligning faces of the pair of aligning members is set as a second distance, the second distance being wider than the first distance and being wider than a widthwise length of the sheet discharged on the stacking surface.

24. The image forming apparatus according to claim 23, further comprising:

a sheet processing apparatus to which the sheet on which an image has been formed by the image forming portion is sent and including a sheet processing portion configured to process the sheet thus sent;

wherein the sheet discharging portion is provided at a downstream end of a sheet conveying path to discharge the sheet conveyed through the sheet conveying path out of the body of the sheet processing apparatus;

the stacking portion includes a stacking tray and the stacking tray is attached to an outer wall surface of the sheet processing apparatus such that the stacking tray declines toward the outer wall surface; and the abutting member is composed of the outer wall surface of the body of the sheet processing apparatus.

* * * * *